US007059501B2

(12) United States Patent
Masuda

(10) Patent No.: US 7,059,501 B2
(45) Date of Patent: Jun. 13, 2006

(54) VALVE MECHANISM FOR TUBE-TYPE FLUID CONTAINER

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 182 days.

(21) Appl. No.: 10/455,045

(22) Filed: Jun. 5, 2003

(65) Prior Publication Data

US 2003/0230596 A1 Dec. 18, 2003

(30) Foreign Application Priority Data

Jun. 10, 2002 (JP) ..... 2002-168208
Jul. 8, 2002 (JP) ..... 2002-198089

(51) Int. Cl.
*B65D 25/40* (2006.01)

(52) U.S. Cl. ..... 222/494; 222/212

(58) Field of Classification Search ..... 222/494–497, 222/386.5, 209, 212, 286.5
See application file for complete search history.

(56) References Cited

U.S. PATENT DOCUMENTS 2,715,980 A * 8/1955 Frick ..... 222/183
2,755,974 A * 7/1956 Godfrey ..... 222/494
2,777,612 A * 1/1957 Bensen ..... 222/209
3,165,242 A * 1/1965 Jackson ..... 222/495
3,456,650 A 7/1969 Schwartzman
3,490,658 A * 1/1970 Schwartzman ..... 222/402.12
3,506,162 A * 4/1970 Schwartzman ..... 222/207
3,945,540 A 3/1976 Mantchev
4,597,511 A * 7/1986 Licari ..... 222/380
4,785,978 A * 11/1988 Kano et al. ..... 222/482
5,152,434 A 10/1992 Birmelin
5,275,312 A * 1/1994 Labruzzo ..... 222/212
5,819,990 A 10/1998 Cimentepe et al.
5,842,618 A * 12/1998 Julemont et al. ..... 222/490

FOREIGN PATENT DOCUMENTS

| | | |
|---|---|---|
| DE | 4329808 | 3/1995 |
| EP | 0 537 822 A1 | 4/1993 |
| EP | 1 291 288 A2 | 3/2003 |
| FR | 1 433 142 | 3/1966 |
| FR | 2 732 315 A | 10/1996 |
| FR | 2 828 679 A | 2/2003 |
| JP | U 59-26748 | 2/1984 |
| JP | 07-112749 | 5/1995 |
| JP | 08-026311 | 1/1996 |
| JP | 08-034452 | 2/1996 |

(Continued)

*Primary Examiner*—Michael Mar
*Assistant Examiner*—Melvin A. Cartagena
(74) *Attorney, Agent, or Firm*—Knobbe, Martens, Olson & Bear LLP

(57) ABSTRACT

A valve seat portion 20 has a nearly tubular shape, at the bottom of which a circular opening portion 23 which functions as a valve seat is formed. A valve portion 10 has a ring-shaped supporting portion 11 which is disposed inside the valve seat portion 20. A valve body 12 has a shape corresponding to the circular opening portion 23, and multiple coupling portions couple the supporting portion 11 and the valve body 12. In the valve portion 10, the valve body can move between a closed position in which the valve body closes the opening portion 23 in the valve seat portion 20 and an open position in which the valve body opens the opening portion 23 by the flexibility of the four coupling portions 13.

27 Claims, 32 Drawing Sheets

FOREIGN PATENT DOCUMENTS

| | | |
|---|---|---|
| JP | 09 240701 A | 9/1997 |
| JP | 10-157751 | 6/1998 |
| JP | 2001 240089 A | 9/2001 |
| KR | 20-0241101 | 7/2001 |
| WO | WO 89/01104 | 2/1989 |
| WO | WO 95/10965 | 4/1995 |
| WO | WO 02/22458 A1 | 3/2002 |

* cited by examiner

VALVE MECHANISM FOR TUBE-TYPE FLUID CONTAINER

BACKGROUND OF THE INVENTION

The present invention relates to a valve mechanism, particularly to a valve mechanism which can be used for a tube-type fluid container.

As this type of valve mechanism, for example, as described in Japanese Patent Laid-open No. 2001-179139, a valve mechanism having a spherical valve body and a spring for giving momentum to the valve body toward a valve seat has been used. Manufacturing costs of the valve mechanism using the spherical valve body and the spring, however, tend to be high.

Consequently, a valve mechanism having a resinous valve seat, and a resinous valve body which moves between a closed position in which the valve body contacts the valve seat and an open position in which the valve body separates from the valve seat is commonly used.

In the resinous valve mechanism, it is preferred that the valve mechanism has a simple configuration which can close a fluid flow reliably. Additionally, it is preferred that the configuration can alter a flow rate of the fluid passing through the valve mechanism discretionally according to a pressure applied to the fluid. As matters stand, however, a valve mechanism satisfying these requirements is not reported.

SUMMARY OF THE INVENTION

The present invention has been achieved to solve the above-mentioned problems. It aims to provide a valve mechanism which can close a fluid reliably while its configuration is simple and which can alter a flow rate of the fluid passing through the valve mechanism discretionally according to a pressure applied to the fluid.

The present invention includes, but is not limited to, the following embodiments. Solely for the sake of understanding some embodiments of the present invention easily, reference numerals used in the figures explained later are referred to. However, the present invention is not limited to the structures defined by these reference numerals, and any suitable combination of elements indicated by these reference numerals can be accomplished.

In an embodiment, a valve mechanism adapted for a mouth portion (or a fluid dispensing port; e.g., 141) of a tube-type fluid container (e.g. 140, 1140) may comprise: (I) a valve seat portion (e.g., 20, 220) being cup-shaped having an opening (e.g., 23, 26) at its bottom through which a fluid passes, said valve seat portion having an inner wall (e.g., 201); and (II) a resinous valve portion (e.g., 10, 30, 40, 50, 60, 70) comprising: (i) a valve body (e.g., 12, 42, 52, 62, 72) having a shape corresponding to said opening; (ii) an annular support (e.g., 11, 41, 51, 61, 71) fixedly attached to the inner wall of the valve seat portion; and (iii) multiple connectors (e.g., 13, 43, 53, 63, 73) connecting the valve body and the support, said connectors elastically urging the valve body downward to close the opening and being outwardly bendable as the valve body moves upward, wherein when the valve body is moved upward to open the opening, the connectors move outward toward the inner wall (e.g., in a radial direction). In an embodiment, the connectors may be substantially or completely in contact with the inner wall (e.g., 101, 301, 401, 501, 601, 701) when moving outward and may restrict a further upward movement of the valve body.

In the above, the valve mechanism may include, but is not limited to, the following configurations:

The connectors may comprise at least three coupling portions (e.g., 13, 43, 53, 63, 73, 79). The coupling portions may have flections (e.g., 14, 44, 54, 64). The valve mechanism may further comprise a guide mechanism (e.g., 29, 16, 76, 77) which guides an upward and downward movement of the valve body. The guide mechanism may comprise (a) a vertical guide pin (e.g., 29) provided in said valve body and (b) a hole portion (e.g., 16) having a hole (e.g., 19) wherein the guide pin is inserted, said hole portion being attached to an inner wall (e.g., 302) of the valve seat portion. Alternatively, the guide mechanism may comprise (a) a guide plate (e.g., 77) having an outer diameter smaller than an inner diameter of the annular support and being slidable against an inner wall (e.g., 702) of the annular support, and (b) a rod (e.g., 76) connecting the guide plate and the valve body. Each of the valve seat portion and the valve portion may be formed with a single integrated piece made of a resin.

In an embodiment, the valve seat portion (e.g., 220) may be comprised of a cylindrical support (e.g., 221) having an upper opening (e.g., 225) and a lower opening (e.g., 226), through which a fluid passes; and a valve seat (e.g., 122) having an opening (e.g., 123) at its bottom through which the fluid passes, said valve seat being fitted in inside the lower opening of the cylindrical support.

In another embodiment, a valve mechanism adapted for a mouth portion of a tube-type fluid container (e.g., 140, 1140) may comprise: (I) a valve seat portion (e.g., 20, 220) being cup-shaped having an opening (e.g., 23) at its bottom through which a fluid passes, said valve seat portion having an inner wall (e.g., 201); (II) a resinous valve portion (e.g., 30, 70) comprising: (i) a valve body (e.g., 12, 72) having a shape corresponding to said opening; (ii) an annular support (e.g., 11, 71) fixedly attached to the inner wall of the valve seat portion; and (iii) multiple connectors (e.g., 13, 73, 79) connecting the valve body and the support, said connectors elastically urging the valve body downward to close the opening and being bendable as the valve body moves upward; and (RI) a guide mechanism (e.g., 29, 16, 76, 77) which guides an upward and downward movement of the valve body and restricts a sideways movement of the valve body.

In the above, the valve mechanism may include, but is not limited to, the following configurations:

The guide mechanism may not be subject to deformation (e.g., 29, 16, 76, 77). The guide mechanism may comprise (a), a vertical guide pin (e.g., 29) provided in said valve body and (b) a hole portion (e.g., 16) having a hole (e.g., 19) wherein the guide pin is inserted, said hole portion being attached to an inner wall (e.g., 201) of the valve seat portion. The guide mechanism may comprise (a) a guide plate (e.g., 77) having an outer diameter smaller than an inner diameter of the annular support and being slidable against an inner wall (e.g., 702, 702') of the annular support, and (b) a rod (e.g., 76) connecting the guide plate and the valve body. The connectors may comprise at least three coupling portions (e.g., 13, 73, 79). The coupling portions may have flections (e.g., 14).

In an embodiment, the valve seat portion (e.g., 220) may be comprised of a cylindrical support (e.g., 221) having an upper opening (e.g., 225) and a lower opening (e.g., 226), through which a fluid passes; and a valve seat (e.g., 122) having an opening (e.g., 123) at its bottom through which the fluid passes, said valve seat being fitted in inside the lower opening of the cylindrical support.

In still another embodiment, a valve mechanism adapted for a mouth portion of a tube-type fluid container (e.g., 140, 1140) may comprise: (I) a cylindrical support (e.g., 221) having an upper opening (e.g., 225) and a lower opening (e.g., 226), through which a fluid passes; (II) a valve seat portion (e.g., 122) having an opening (e.g., 212) at its bottom through which the fluid passes, said valve seat portion being fitted in inside the lower opening of the cylindrical support; and (III) a resinous valve portion comprising: (i) a valve body (e.g., 212) having a shape corresponding to the opening of the valve seat; and (ii) multiple connectors (e.g., 213) connecting the valve body to an inner wall (e.g., 201') of the cylindrical support, said connectors elastically urging the valve body downward to close the opening and being bendable as the valve body moves upward.

In the above, the valve mechanism may include, but is not limited to, the following configurations:

The connectors may comprise at least three coupling portions (e.g., 213). The coupling portions may have flections (e.g., 214). Each of the valve seat portion and the valve portion may be formed with a single integrated piece made of a resin (e.g., 80, 122).

Another aspect of the present invention is a tube-type fluid container comprising a container body (e.g., 140, 1140) for storing a fluid having a mouth portion (e.g., 141, 1141), and any of the foregoing valve mechanisms (any suitable combination of elements thereof) attached to the mouth portion.

In the above, the container body may be a double wall container body (e.g., 1140) comprised of an inner container (e.g., 1142) for storing a fluid and an outer container (e.g., 1143), said inner container being flexible and compressible, said outer container having at least one through-hole (e.g., 1149, 1149') for keeping an interior space between the inner container and the outer container at ambient pressure. The through-hole (e.g., 1149') may have a size which can let a small amount of air through. The through-hole (e.g., 1149) may be formed in a portion to which a pressure is applied when the fluid is discharged. The inner container and the outer container are integrated at the mouth portion (e.g., 1148), and welded at their bottoms (e.g., 1147).

According to any of the foregoing valve mechanisms, a fluid can be closed reliably although its configuration is simple; a flow rate of the fluid passing through the valve mechanism can be changed discretionally according to a pressure applied to the valve mechanism. When using three or more connectors, the occurrence of an inadequate tilt in the valve body can effectively be prevented. When configuring the connectors to be substantially in contact with an inner wall of the valve seat portion, it becomes possible to more reliably prevent an inadequate tilt in the valve body from occurring. When forming flections in the connectors, the connectors have an adequate elasticity recovering force, moving the valve body satisfactorily between a closed position and an open position becomes possible. When using the guide mechanism which guides the valve body's movement from the closed position to the open position, it becomes possible to further reliably prevent an inadequate tilt in the valve body from occurring. When configuring the valve seat to be a separate piece from the cylindrical support and be fitted in the lower opening of the cylindrical support, and/or when forming the valve body, the connectors, and the cylindrical support as an integrated single piece, influence by plastic deformation caused during manufacturing processes (e.g., inflation molding) can be reduced, improving sealability between the valve body and the valve seat and improving assembly operation.

In the above, the fluid can be discharged from an outlet of the mouth portion of the container through the valve mechanism by pressing the container, wherein the connectors and the container are deformed. When releasing the pressure, both the deformed connectors and the deformed container begin restoring the shapes. The restoring force of the container causes the inner pressure to lower, thereby generating reverse flow which facilitates restoration of the connectors to close the opening of the valve seat portion, thereby effectively preventing air from coming into the container through the outlet of the mouth portion. Thus, even if the restoring force of the connectors themselves is not sufficient to close the opening of the valve seat portion, the outlet of the mouth portion can effectively be closed in combination with the restoring force of the container. Thus, even if the fluid is very viscous, the valve mechanism in combination with the container can discharge the fluid and then seal the container.

In the above, in the event that the restoring force of the container is excessive (depending on the viscosity of the fluid and the amount of the fluid remaining in the container, etc., in addition to the elasticity characteristics of the container itself), the reverse flow is strong and fast, and the connectors may not be restored so quickly that it is difficult to prevent air from coming into the container from the outlet of the mouth portion through the opening of the valve seat portion. In that case, by using a double wall container, the restoring force can be controlled so that intensity of the reverse flow can be controlled to prevent air from coming into the container.

That is, when configuring the container body to be a double wall container, despite its simple configuration, reverse flow of air from the discharge port (or the mouth) of the container into the container can be prevented and the content can be discharged easily even when an amount of the content is reduced. When forming the through-hole in the outer container in a size which can let a small amount of air through, an amount of air outflow from the inner container to the outside can be controlled to be small, enabling to apply appropriate pressure to the fluid inside the inner container because certain pressure between the inner container and the outer container can be maintained when the outer container is pressed. Wen forming the through-hole in a portion to which a pressure is applied when the fluid is discharged, an amount of air outflow from the inner container to the outside can be controlled to be small when the outer container is pressed, enabling to apply an appropriate pressure to the fluid inside the inner container. When integrating the inner container and the outer container at the mouth portion and welding them at their bottom, manufacturing a tube-type fluid container at low costs becomes possible.

Additionally, in a double wall container, restoring force of an inner container may be lower than that of a single wall container, and thus, after connectors are at a closed position, the pressure inside the inner container may remain moderately lower than the ambient pressure, so that suction force at the outlet may not be significant. In that case, it is possible to effectively prevent air from coming into the container. Further, in a double wall container, an outer container can be restored more than an inner container, and an air layer is formed between the inner container and the outer container. When restricting the flow of air released from the air layer through a through-hole or though-holes, it is possible to exert pressure on the inner container from the outer container via the air layer. Thus, even if the amount of the fluid contained in the inner container is low and thus, the inner container is nearly flat, by pressing the outer container which has been restored to the original shape, it is possible to exert pressure onto the inner container, thereby easily discharging the fluid. Accordingly, waste of the fluid remaining inside the inner container can be minimized.

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

FIG. 21A is a top view, FIG. 21B is a cross sectional view, FIG. 21C is a bottom view, and FIG. 21D is a side view.

FIG. 22A is a top view, FIG. 22B is a cross sectional view, FIG. 22C is a bottom view, and FIG. 22D is a side view.

FIG. 23A is a top view, FIG. 23B is a side view, FIG. 23C is a cross sectional view, and FIG. 23D is a bottom view.

Explanation of symbols used is as follows: 10: Valve portion; 11: Supporting portion; 12: Valve body; 13: Coupling portion; 14: Flections; 15: Concave portion; 16: Guide material; 17: Supporting portion; 18: Coupling portion; 19: Hole portion for guiding; 20: Valve seat portion; 23: Opening portion; 24: Protruding portion; 26: Opening portion; 29: Guide pin; 30: Valve portion; 40: Valve portion; 41: Supporting portion; 42: Valve body; 43: Coupling portion; 44: Flections; 50: Valve portion; 51: Supporting portion; 52: Valve body; 53: Coupling portion; 54: Flections; 60: Valve portion; 61: Supporting portion; 62: Valve body; 63: Coupling portion; 64: Flection; 70: Valve portion; 71: Supporting portion; 72: Valve body; 73: Coupling portion; 76: Coupling material; 77: Guide plate; 110: Lid material; 111: Lid portion; 112: Lid body; 113: Opening portion; 114: Closed portion; 115: Female screw portion; 140: Container main unit; 141: Opening portion; 142: Fluid storing portion; 143: Flange portion; 144: Male screw portion; 1140: Container main unit; 1141: Discharge port; 1142: Internal container; 1143: External container; 1144: Internal space; 1145: Internal container opening portion; 1146: External container opening portion; 1147: Welding portion on the bottom side; 1148: Welding portion on the discharge port side; 1149: Hole.

DETAILED DESCRIPTION OF THE PREFERRED EMBODIMENT

Figure 1:
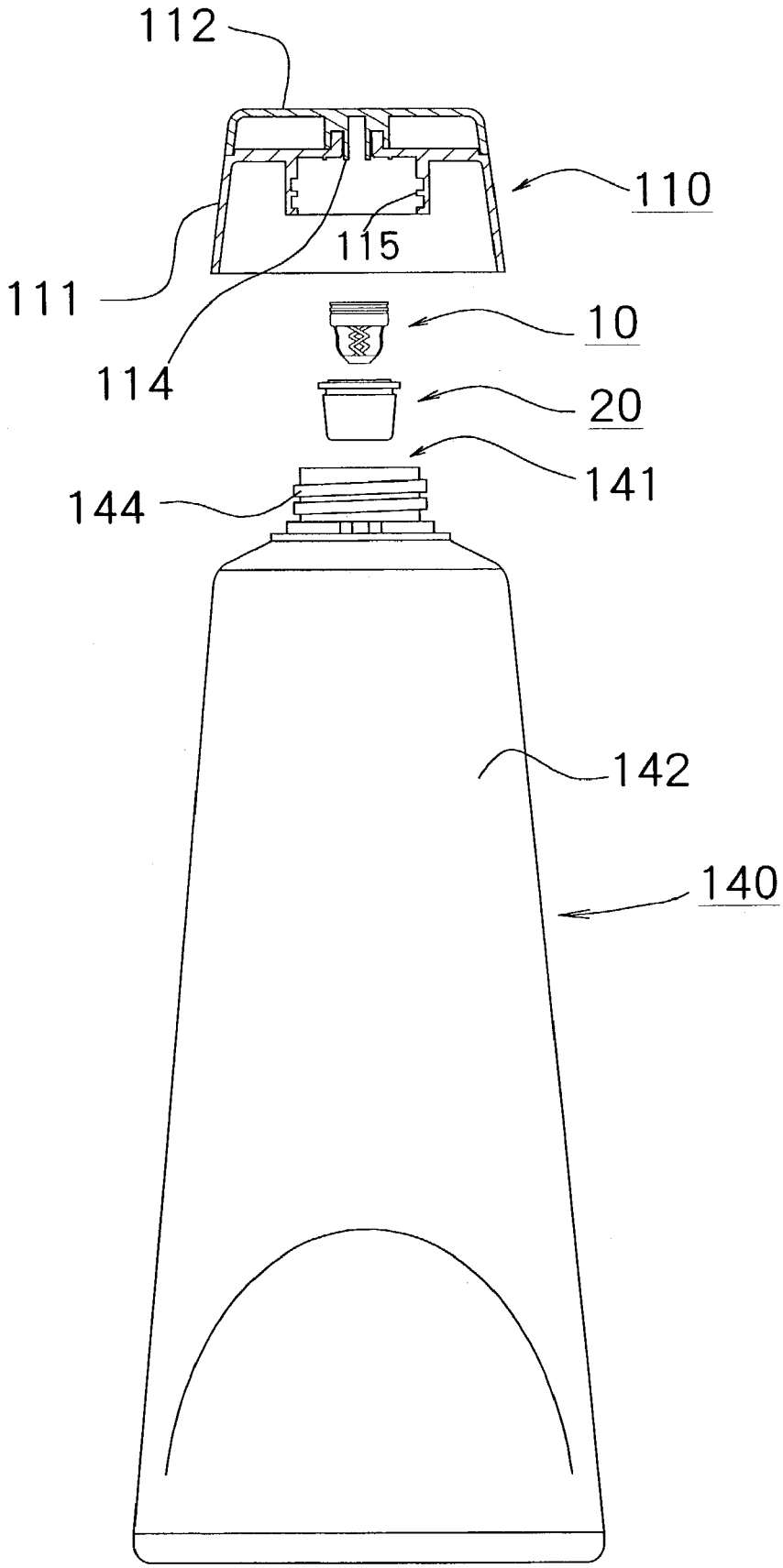
FIG. 1 is a schematic diagram of a tube-type container to which a valve mechanism according to an embodiment of the present invention applies.
Figure 2:
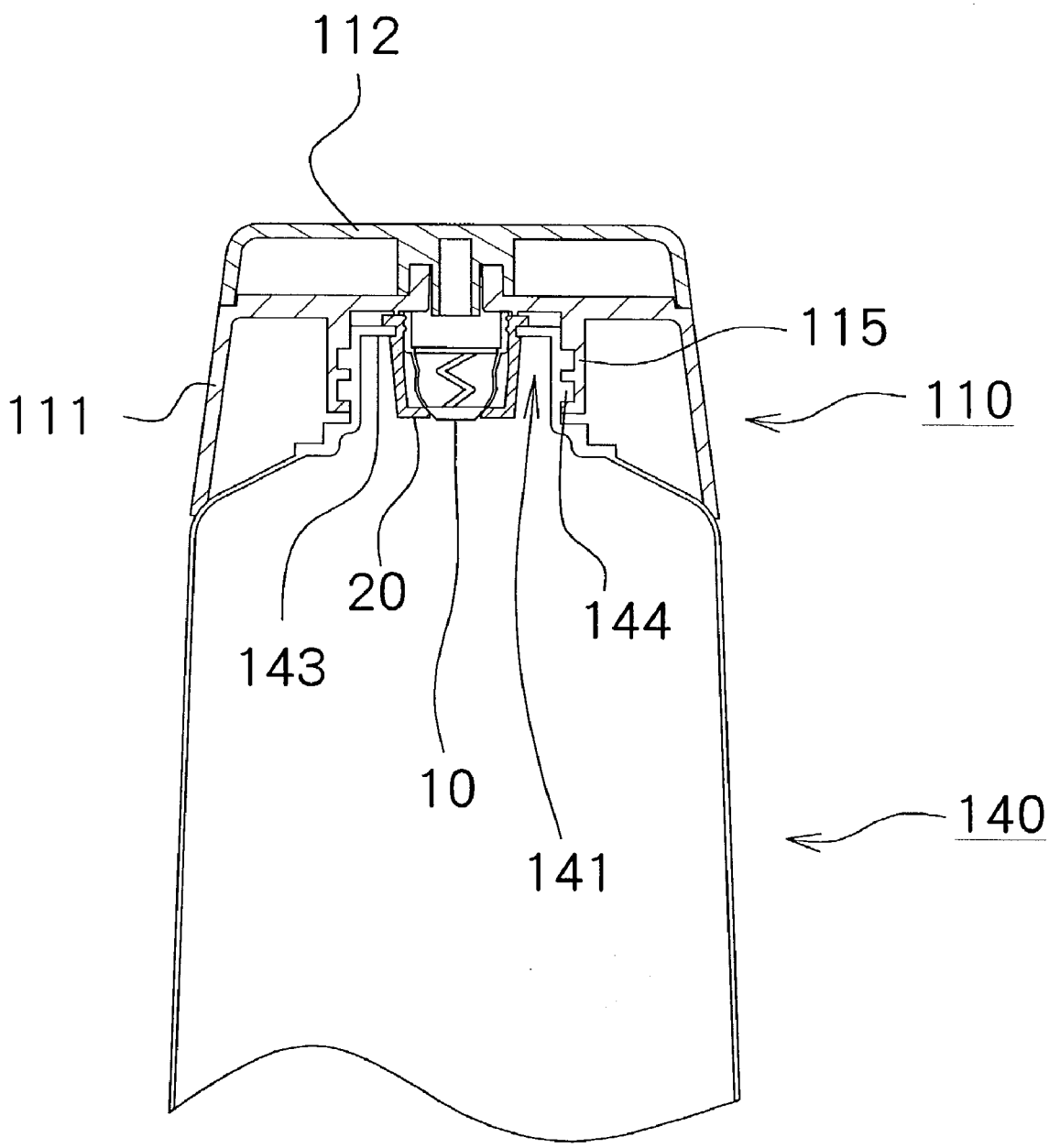
FIG. 2 is an enlarged view showing the relevant part of the tube-type container to which the valve mechanism according to an embodiment of the present invention applies.
Figure 3:
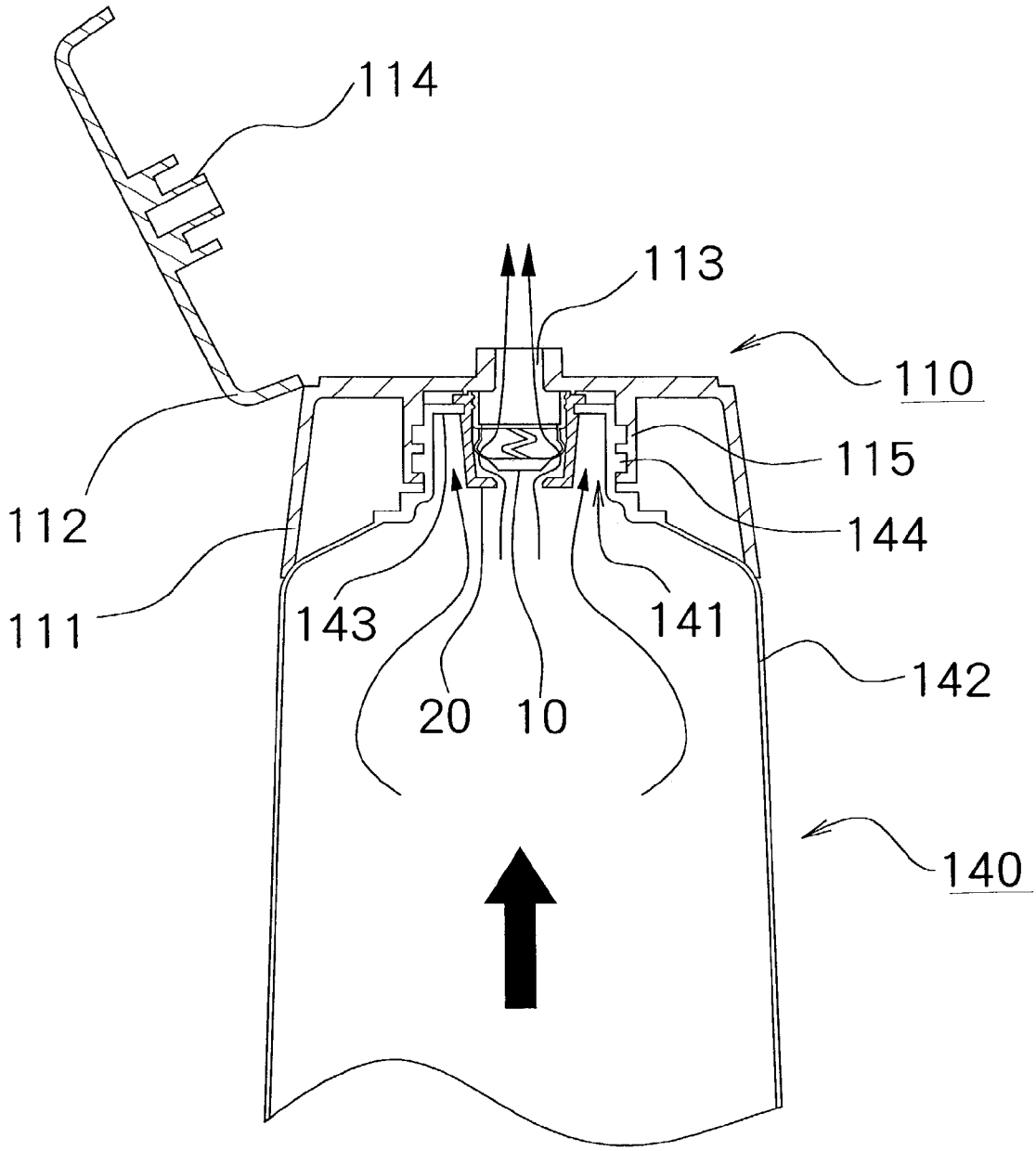
FIG. 3 is an enlarged view showing the relevant part of the tube-type container to which the valve mechanism according to an embodiment of the present invention applies.
Figure 4:
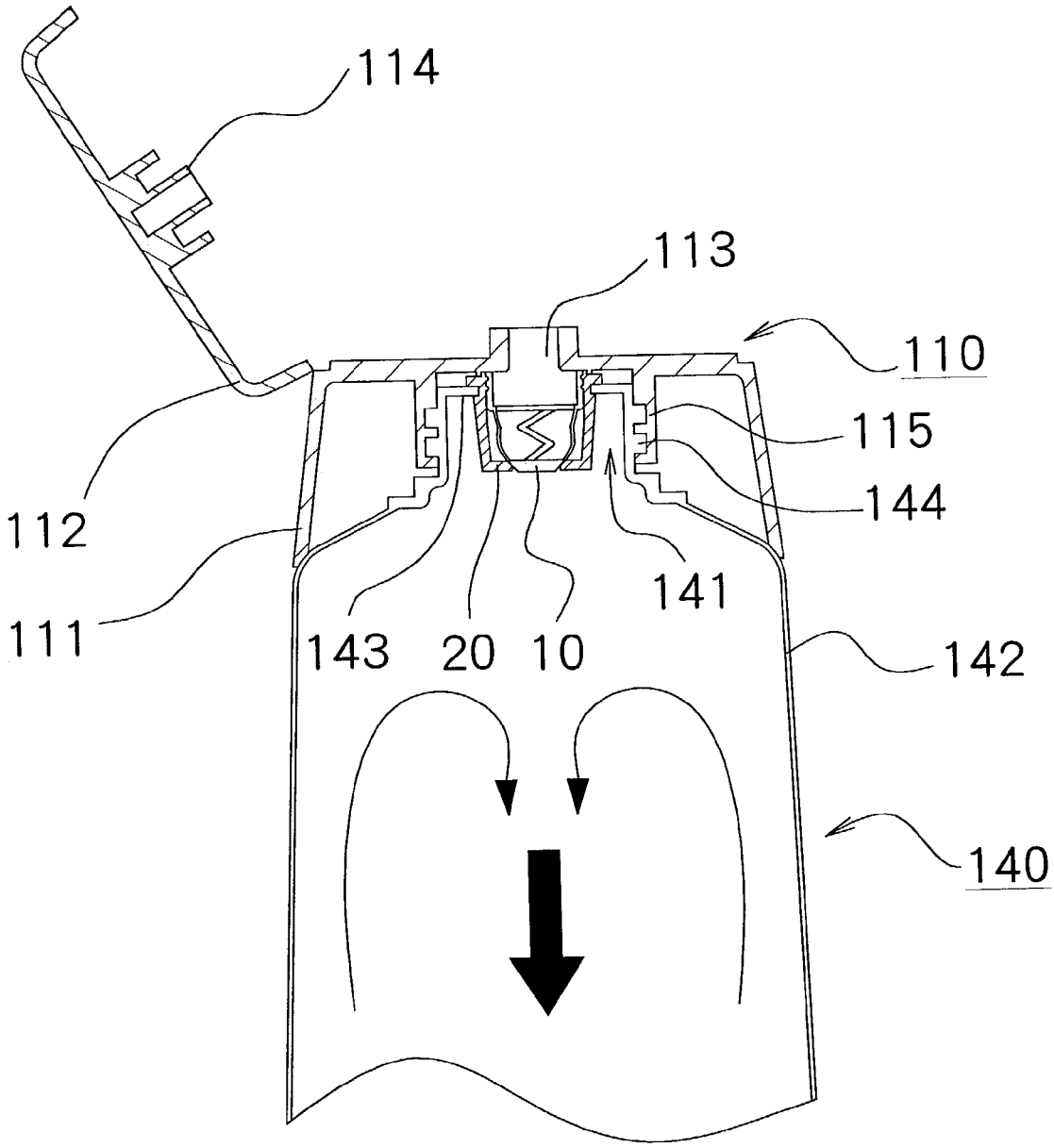
FIG. 4 is an enlarged view showing the relevant part of the tube-type container to which the valve mechanism according to an embodiment of the present invention applies.

Preferred embodiments of the present invention will be described with referent to the drawings. The present invention is not limited to the embodiments. FIG. 1 is an exploded illustration showing a tube-type container to which the valve mechanism according to an embodiment of the present invention applies; FIG. 2 to FIG. 4 are enlarged views of the relevant part of the tube-type container to which the valve mechanism according to an embodiment of the present invention applies.

This tube-type container may be used as a container for any suitable fluid including beauty products for storing gels such as hair gels and cleansing gels or creams such as nourishing creams and cold creams used in the cosmetic field. This tube-type container also can be used as a container for medicines, solvents or foods, etc.

In this specification, high-viscosity liquids, semifluids, gels that sol solidifies to a jelly, and creams, and regular liquids, are all referred to as fluids. The present invention, however, is not limited to a valve mechanism used for the above-mentioned fluids and can apply to a valve mechanism used for the entire fluids including gases.

This tube-type container comprises a container main unit 140, a lid material 110 placed at the top of the container main unit 140, and a valve portion 10 and a valve seat portion 20 comprising a valve mechanism.

The container main unit 140 comprises a fluid storing portion 142 for storing a fluid inside it, an opening portion 141 for discharging the fluid, which is formed at one end of the fluid storing portion 142, a flange portion 143 formed in the vicinity of the upper end of the opening portion 141, and a male screw portion 144 formed outside the opening portion 141. The flange portion 143 can engage with an engaging groove 21 in the valve seat portion 20, which is described later in detail. For this purpose, the valve seat portion 20 has a configuration in which it is fixed inside the opening portion 141 in the container main unit 140 via this engaging groove 21.

The container main unit 140 comprises synthetic resin alone or a lamination of synthetic resin and aluminum, and has an elasticity recovering force which tries to recover its original shape when a pressure applied to it is removed.

The above-mentioned lid material 110 comprises a base portion 111 at the center of which an opening portion 113 (See FIG. 3 and FIG. 4.), a female screw portion 115 formed in the base portion 111, and a lid body 112 at the bottom center of which a closed portion 114 is formed. The lid body 112 is constructed in such a way that it is functional like a hinge with the base portion 111, as shown in FIG. 4. Consequently, the lid body 112 moves between a position as shown in FIG. 2, in which the closed position 114 closes the opening portion 113 formed at the base portion 111, and a position as shown in FIG. 3 and FIG. 4, in which the closed position 114 opens the opening portion 113 formed at the base portion 111. The female screw portion 115 formed at the base portion 111 is constructed so that it screws together with the male screw portion 144 formed at the container main unit 140.

In the a tube-type container having the above-mentioned configuration, when a fluid is discharged from the container, a pressure is applied to the fluid inside the fluid storing portion 142 by pressing the fluid storing portion 142 in the container main unit 140. In this position, the valve mechanism comprising the valve portion 10 and the valve seat portion 20 is opened; the fluid inside the fluid storing portion 142 is discharged outward via the opening portion 113 in the lid material 110 as shown in FIG. 3.

After a necessary amount of the fluid is discharged and when the pressure applied to the fluid storing portion 142 is removed, the fluid inside the fluid storing portion 142 is depressurized by the elasticity recovering force of the container main unit 140 and the air tries to flow back toward the fluid storing portion 142 from the opening portion 141 used for discharging the fluid.

In this tube-type container, however, by the action of the valve mechanism comprising the valve portion 10 and the valve seating portion 20, a path in which the fluid passes through is closed. Consequently, reverse air flow can be effectively prevented.

In the above-mentioned embodiment, the lid material 110 comprising the base portion 111 at the center of which the opening portion 113 is formed and the lid body 112 at the bottom center of which the closed portion 114 is formed, is used. It is possible to use a lid material having a configuration in which the base portion 111 and the lid body 112 are integrated and the entire lid material is detached from the container main unit 140 when the fluid is discharged.

Figure 5A:
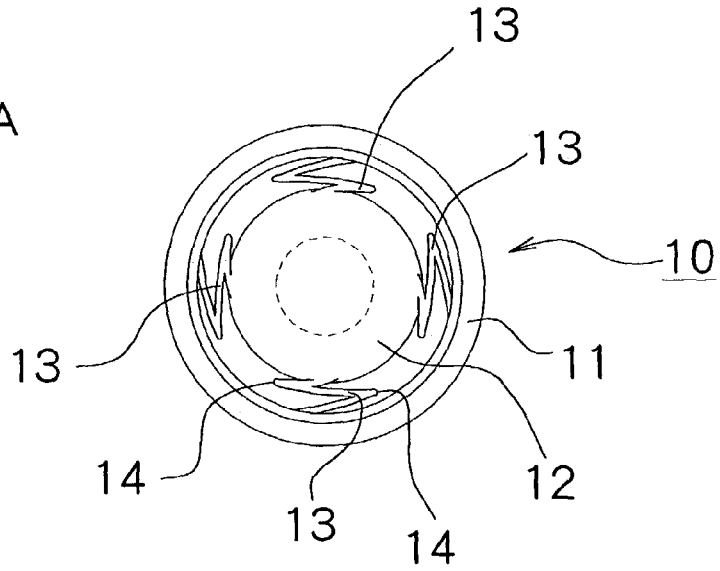
FIG. 5A and FIG. 5B are schematic diagrams showing the valve portion 10 and the valve seat portion 20 comprising the valve mechanism according to Embodiment 1 of the present invention.
Figure 5A:
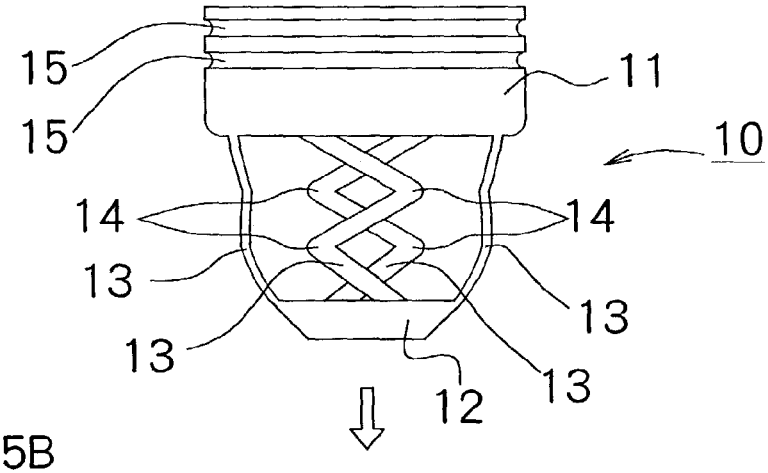
Figure 5B:
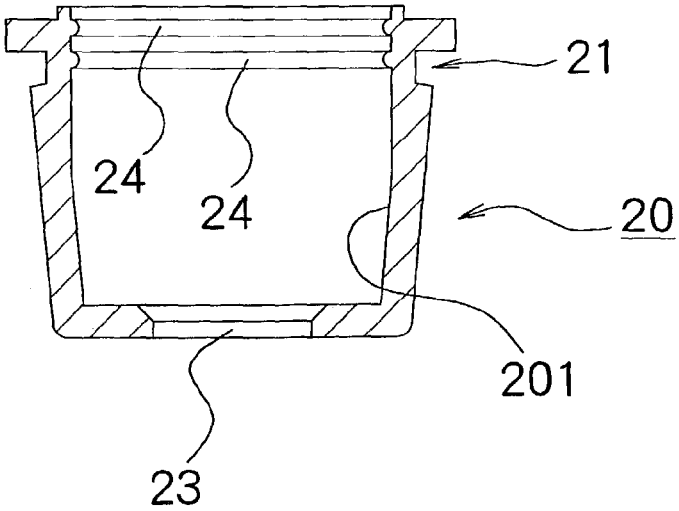
Figure 6A:
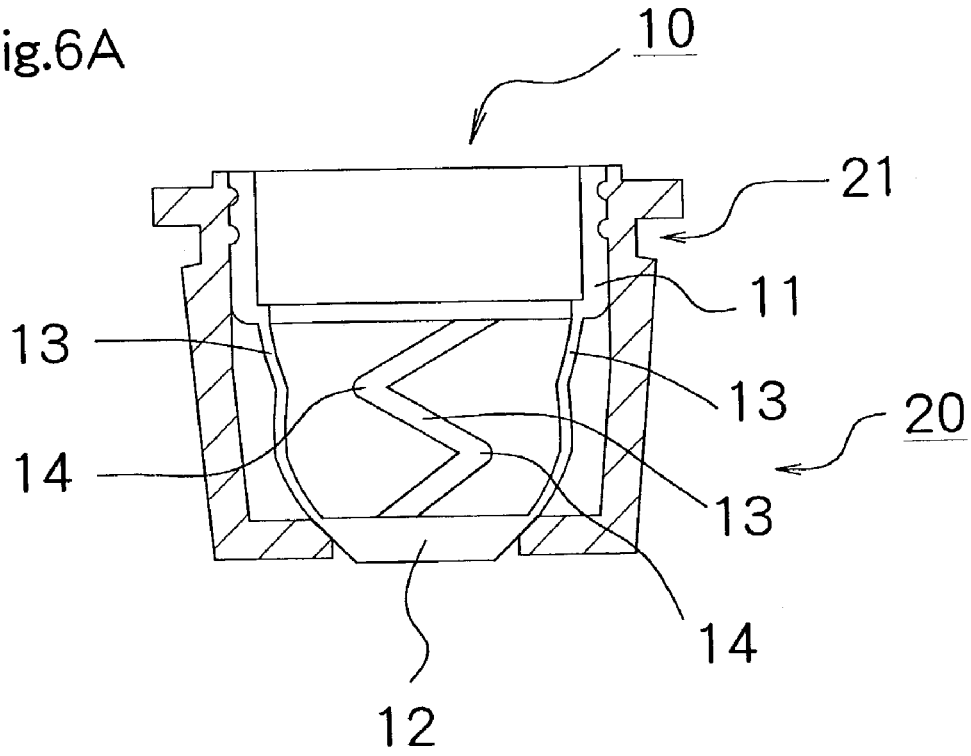
FIG. 6A and FIG. 6B are sectional views showing the motion of the valve mechanism according to Embodiment 1 of the present invention.
Figure 6B:
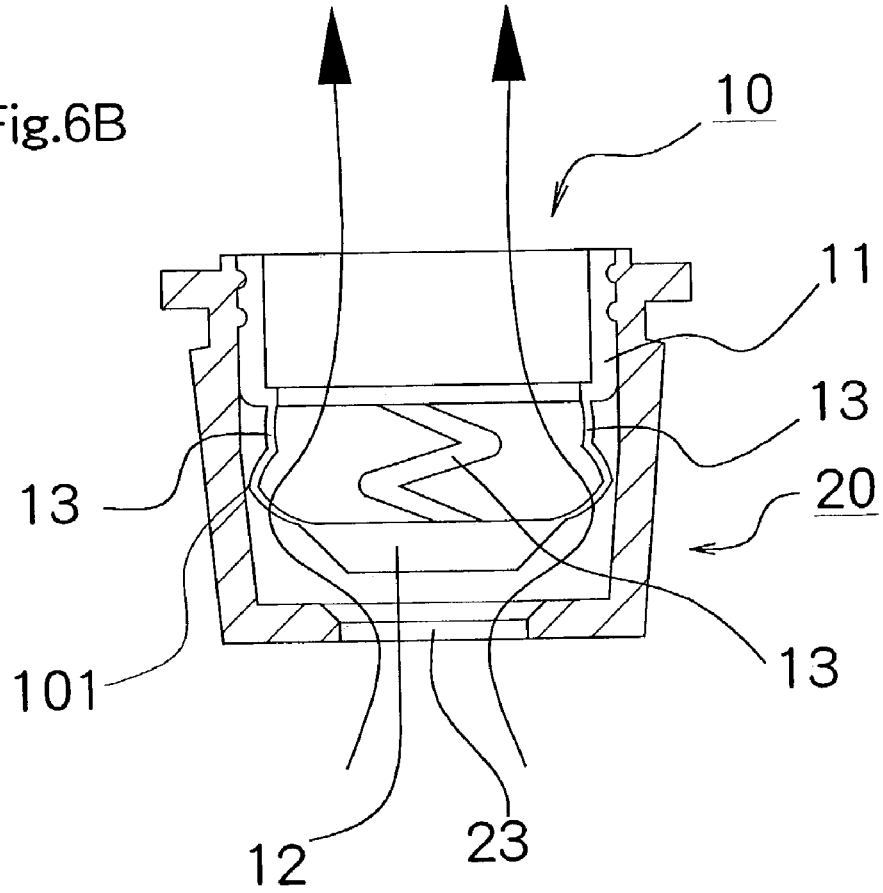

A configuration of the valve mechanism according to the present invention is described below. FIGS. 5A and 5B are illustrations showing the valve portion 10 and the valve seat portion 20, which comprise the valve mechanism according to Embodiment 1 of the present invention. FIGS. 6A and 6B are sectional views showing the motion of the valve mechanism. Additionally, FIG. 5A shows a plan view of the valve portion 10; FIG. 5B shows a view that the valve portion 10 and the valve seat portion 20 are assembled. In FIG. 5B, a lateral view of the valve portion 10 and a sectional view of the valve seat portion 20 are shown.

As shown by these views, the valve seat portion 20 has a nearly tubular shape, at the bottom of which a circular opening portion 23 functioning as a valve seat is formed. Upward inside this valve seat portion 20, a pair of protruding portions 24 are formed.

The valve portion 10 has a ring-shaped supporting portion 11 which is arranged inside the valve portion 20, a valve body 12 having a shape corresponding to the circular opening portion 23 in the valve seat portion 20, and four coupling portions 13 which couple the supporting portion 11 and the valve body 12. The four coupling portions 13 have a pair of flections 14 respectively. In the valve portion 10, the valve body 12 is constructed in such a way that it can move between the closed position in which the valve body 12 closes the opening portion 23 in the valve seat portion 20 and the open position in which the valve body opens the opening portion 23 by the flexibility of the four coupling portion 13.

On an outer circumferential surface of the supporting portion 11 in the valve portion 10, a pair of concave portions 15 is formed. Consequently, when this valve portion 10 is inserted into the valve seat portion 20, as shown in FIGS. 6A and 6B, a pair of convex portions 24 in the valve seat portion 20 and a pair of concave portions in the valve portion 10 engage with each other, and the valve portion 10 is fixed inside the valve seat portion 20. Additionally, the valve portion 10 and the valve seat portion 20 are produced by injection molding using synthetic resin such as polyethylene, etc.

In a valve mechanism having this configuration, when a pressure is applied to a fluid inside the fluid storing portion 142 by pressing the fluid storing portion 142 of the container main unit 140 shown in FIG. 1 to FIG. 4, the valve body 12 in the valve portion 10 moves to a separated position which is separated from the opening portion 23 in the valve seat portion 20 as shown in FIG. 6B. By this motion, the fluid passes through the opening portion 23. When the pressure applied to the fluid storing portion 142 is removed, the valve body 12 in the valve portion 10 moves to the closed position in which the valve body closes the opening portion 23 in the valve seat portion 20 by the elasticity recovering force of the four coupling portions 13. By this, intrusion of the air from the opening portion 23 to the fluid storing portion 142 can be prevented.

In the above, when the valve body 12 is moved upward to open the opening portion 23, the coupling portion 13 moves outward toward an inner wall 201 (e.g., in a radial direction or in a direction of drawing an arc), and the coupling portion 13 may be substantially or completely in contact with the inner wall 201 at a point 101 when moving outward and may restrict a further upward movement of the valve body 12 (avoiding unbalanced movement) even if the fluid flow is excessive. In the figure, the coupling portion 13 appears to be in contact with the inner wall. However, the coupling portion 13 needs not be in contact with the inner and is not in contact with the inner wall when the fluid flow through the opening portion 23 is not high. The above configuration is equally applicable to FIGS. 8B, 11B, 13B, 15B, and 17B (e.g., 301, 401, 501, 601, 701).

In this valve mechanism, a traveling distance of the valve body 12 changes according to a pressure applied to the fluid storing portion 142, i.e. a pressure applied to the valve mechanism, changing a flow rate of the fluid passing through the opening portion 23 discretionally becomes possible.

In this valve mechanism, the supporting portion 11 in the valve portion 10 and the valve body 12 are coupled by the four coupling portions 13. Consequently, preventing occurrence of an inadequate tilt in the valve body 12 becomes possible. Additionally, to effectively prevent occurrence of an inadequate tilt in the valve body 12, it is preferred to provide three or more coupling portions 13 and to arrange them equally.

In this valve mechanism, when the valve body 12 moves from the closed position to the open position, the coupling portions 13 move in the direction in which they contact the inner walls of the valve seat portion 20. Consequently, when an inadequate tilt occurs in the valve body 12, the coupling portions 13 contact the inner walls of the valve seat portion 20, preventing the valve body 12 from tilting further.

Further, in this valve mechanism, the four coupling portions 13 coupling the supporting portion 11 and the valve body 12 have a pair of flections 14 respectively. Consequently, these coupling portions 13 have appropriate elasticity, enabling the valve body 12 to reciprocate smoothly between the closed position and the open position.

It is preferred that a thickness of these coupling portions 13 is 1 mm or less; a thickness within the ranger of 0.3 mm to 0.5 mm is more preferable. Additionally, a relation between a pressure applied to the fluid inside the fluid storing portion 142 and a discharge amount of the fluid can be adjusted by changing a thickness, a vertical length or a material (hardness) of the coupling portions 13. Or, the relation between a pressure applied to the fluid inside the fluid storing portion 142 and a discharge amount of the fluid also can be adjusted by changing an elastic force by the coupling portions 13 by changing a thickness or a width of the edge portion on the supporting portion 11 side of the coupling portions 13.

Figure 7A:
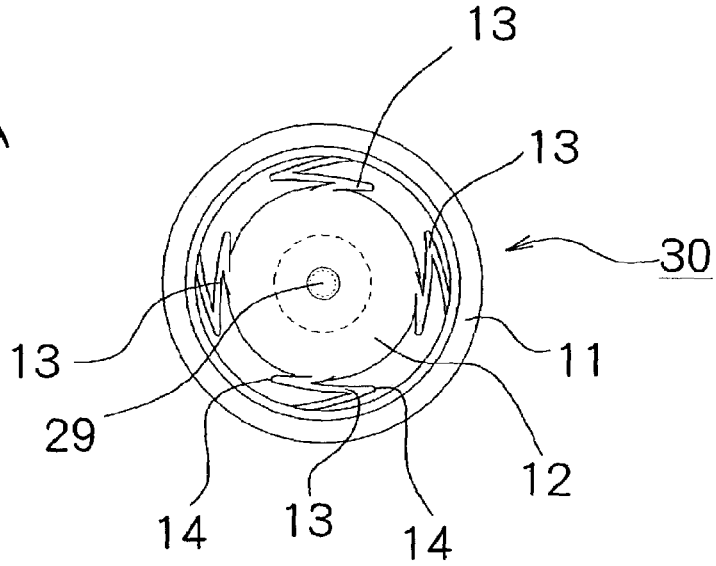
FIG. 7A and FIG. 7B are schematic diagrams showing the valve portion 30 and the valve seat portion 20 comprising the valve mechanism according to Embodiment 2 of the present invention.
Figure 7A:
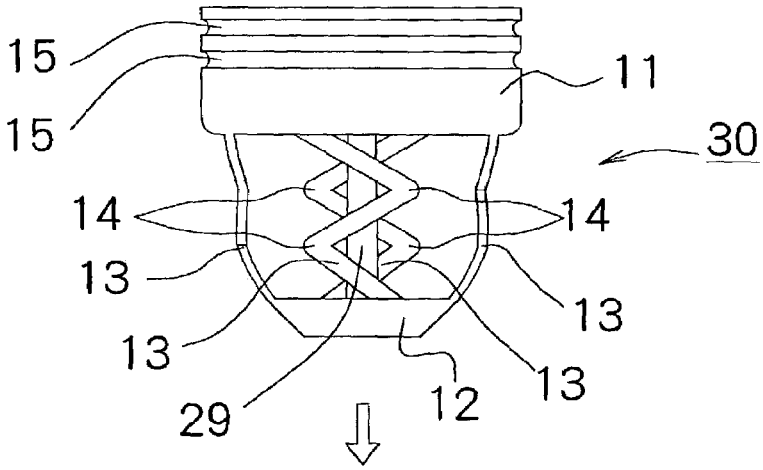
Figure 7B:
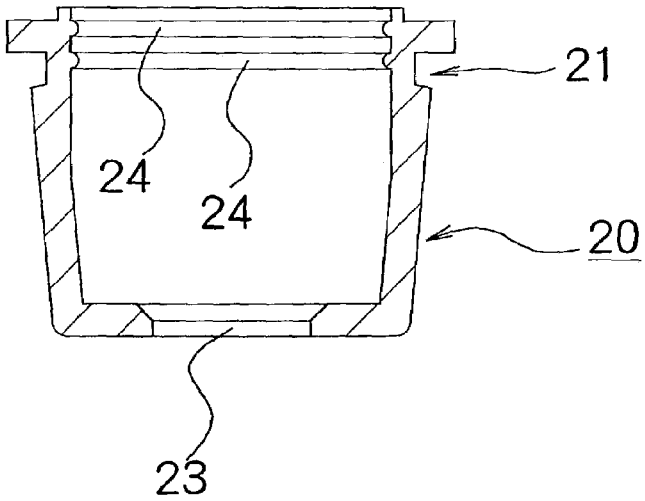
Figure 8A:
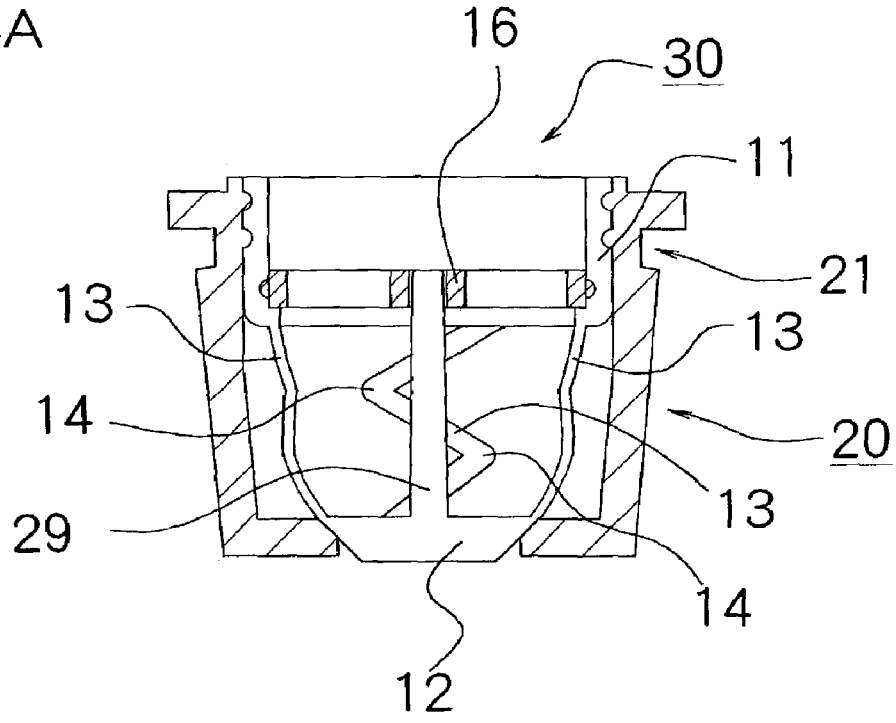
FIG. 8A and 8B are sectional views showing the motion of the valve mechanism according to Embodiment 2 of the present invention.
Figure 8B:
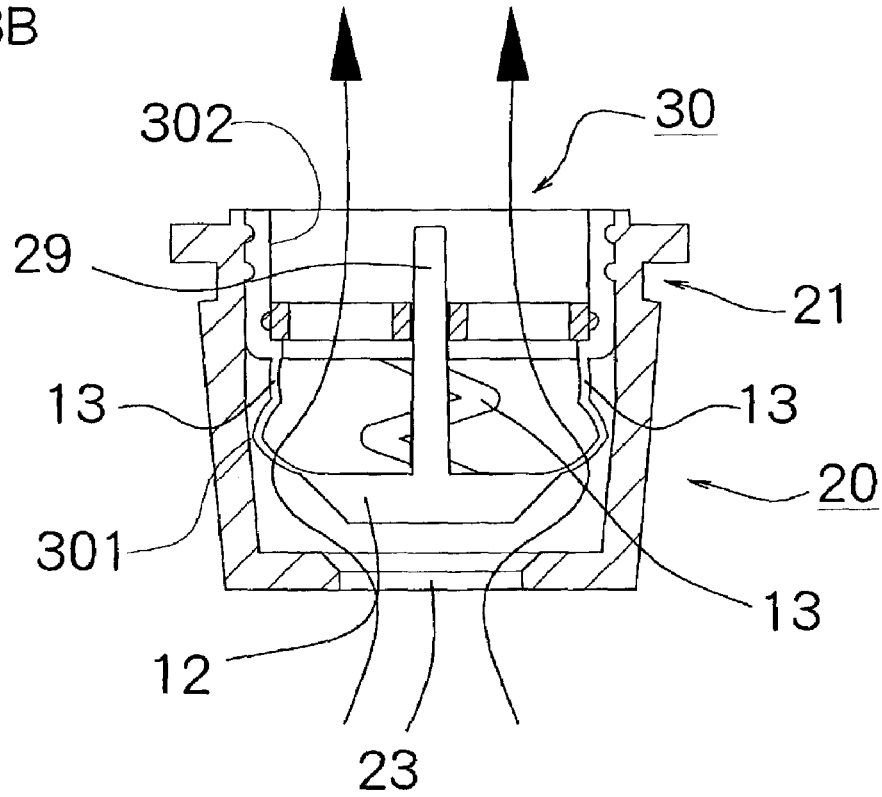
Figure 9A:
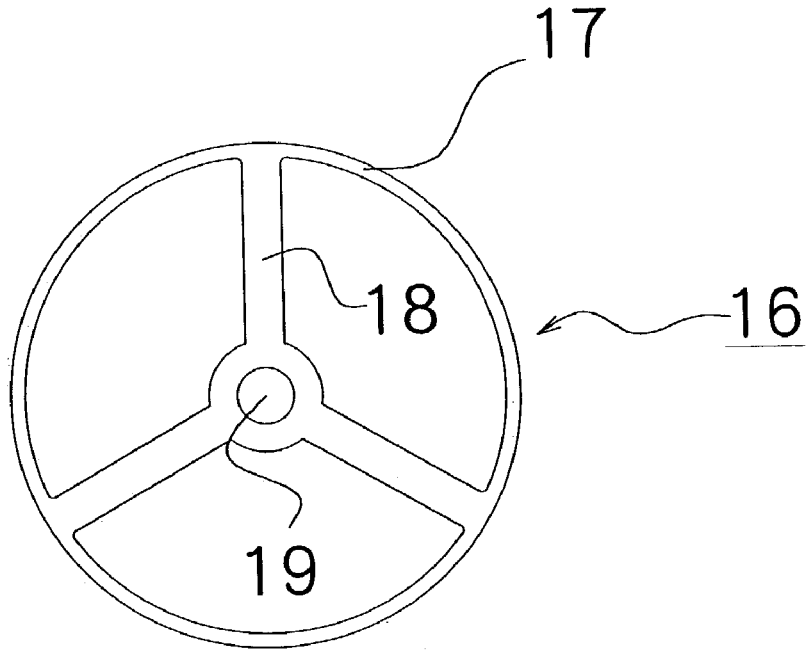
FIG. 9A and FIG. 9B are schematic diagrams showing an example of the guide material 16.
Figure 9B:
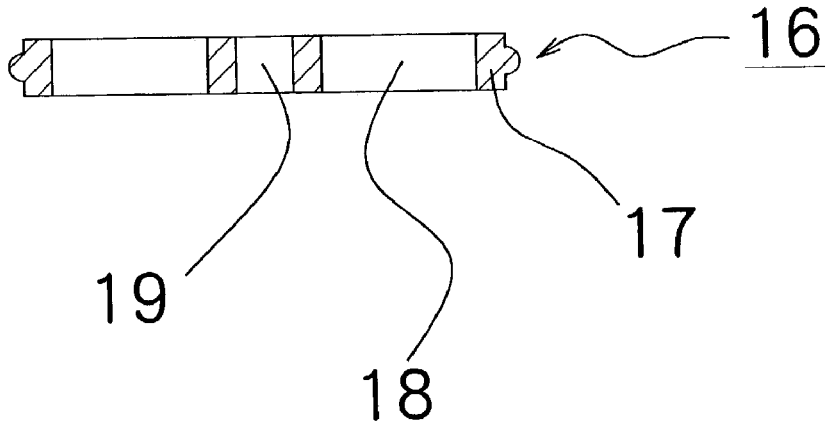

A configuration of the valve mechanism according to Embodiment 2 of the present invention is described below. FIGS. 7A and 7B are illustrations showing a valve portion 30 and a valve seat portion 20 comprising the valve mechanism according to Embodiment 2 of the present invention. FIGS. 8A and 8B are sectional views showing the motion of the valve mechanism. Additionally, FIG. 7A shows a plan view of the valve portion 30; FIG. 7B shows a view that the valve portion 30 and the valve seat portion 20 are assembled. In FIGS. 7A and 7B, a lateral view of the valve portion 30 and a sectional view of the valve seat portion 20 are shown. Additionally, FIGS. 9A and 9B are illustrations showing a guide material 16. FIG. 9A shows its plan view; FIG. 9B shows its lateral view.

The valve mechanism according to Embodiment 2 differs from Embodiment 1 in comprising a guide mechanism for guiding a movement of the valve body 12 from a closed position to an open position to prevent occurrence of an inadequate tilt of the valve body 12 reliably. Additionally, when the same materials are used in this embodiment as those used in Embodiment 1, the same symbols are used and detailed descriptions of the materials are omitted.

In other words, in the valve mechanism according to Embodiment 2, a guide pin 29 is set up by standing it on the top of the valve body 12 in the valve portion 30. A guide material 16 is set up at an inner position of a supporting portion 11 in the valve portion 30. The guide material 16 comprises a ring-shaped supporting portion 17, three coupling portions 18 and a hole portion for guiding 19, which encircles the guide pin 29 from its circumferential portion.

In the valve mechanism according to Embodiment 2, when the valve body 12 moves from the closed position to the open position, occurrence of an inadequate tilt of the valve body 12 is able to be prevented because the guide pin 29, which is provided by standing it in the valve body 12, is guided by the guiding hole portion 19 of the guiding material 16. Additionally, as in this Embodiment 2, when the guide mechanism which guides a movement of the valve body 12 from its closed position to its open position is provided, the number of the coupling portions 13 can be two.

Figure 10A:
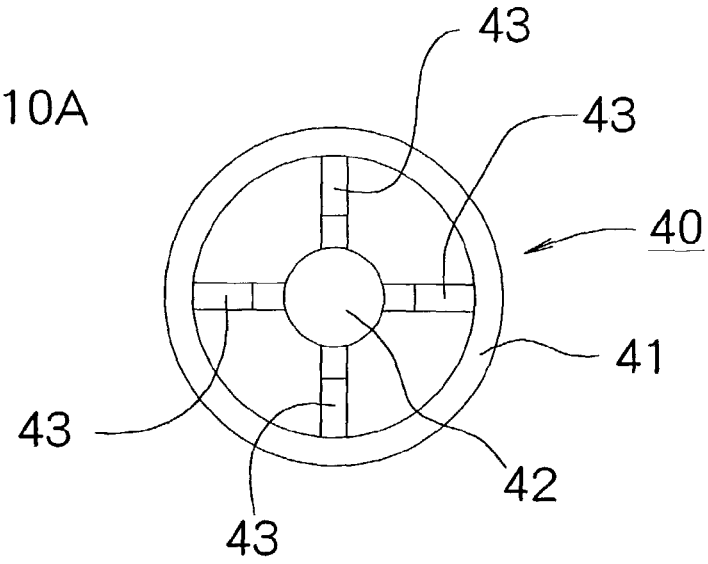
FIG. 10A and FIG. 10B are schematic diagrams showing the valve portion 40 and the valve seat portion 20 comprising the valve mechanism according to Embodiment 3 of the present invention.
Figure 10A:
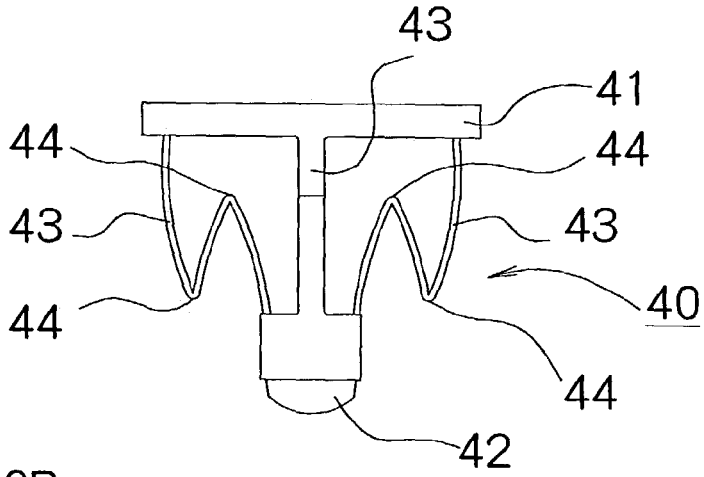
Figure 10B:
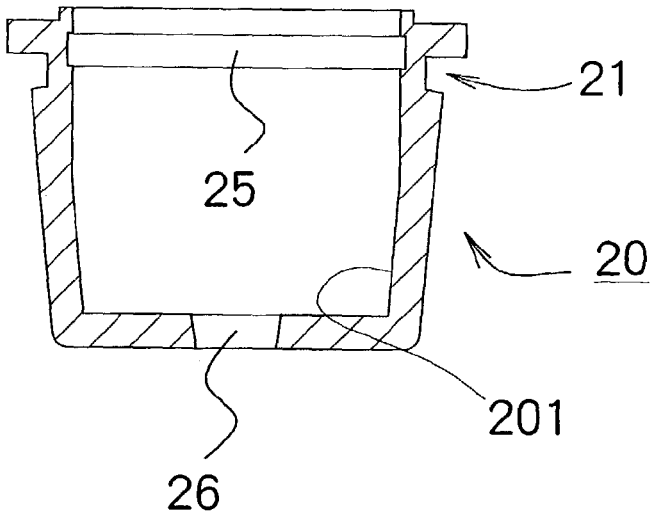
Figure 11A:
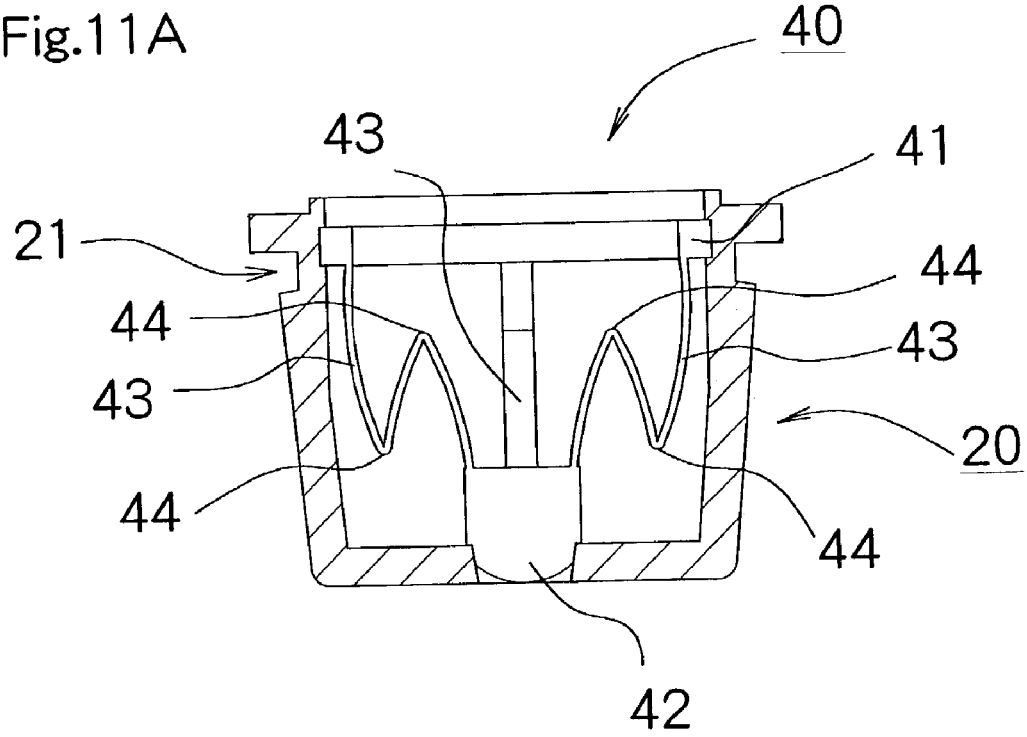
FIG. 11A and FIG. 11B are sectional views showing the motion of the valve mechanism according to Embodiment 3 of the present invention.
Figure 11B:
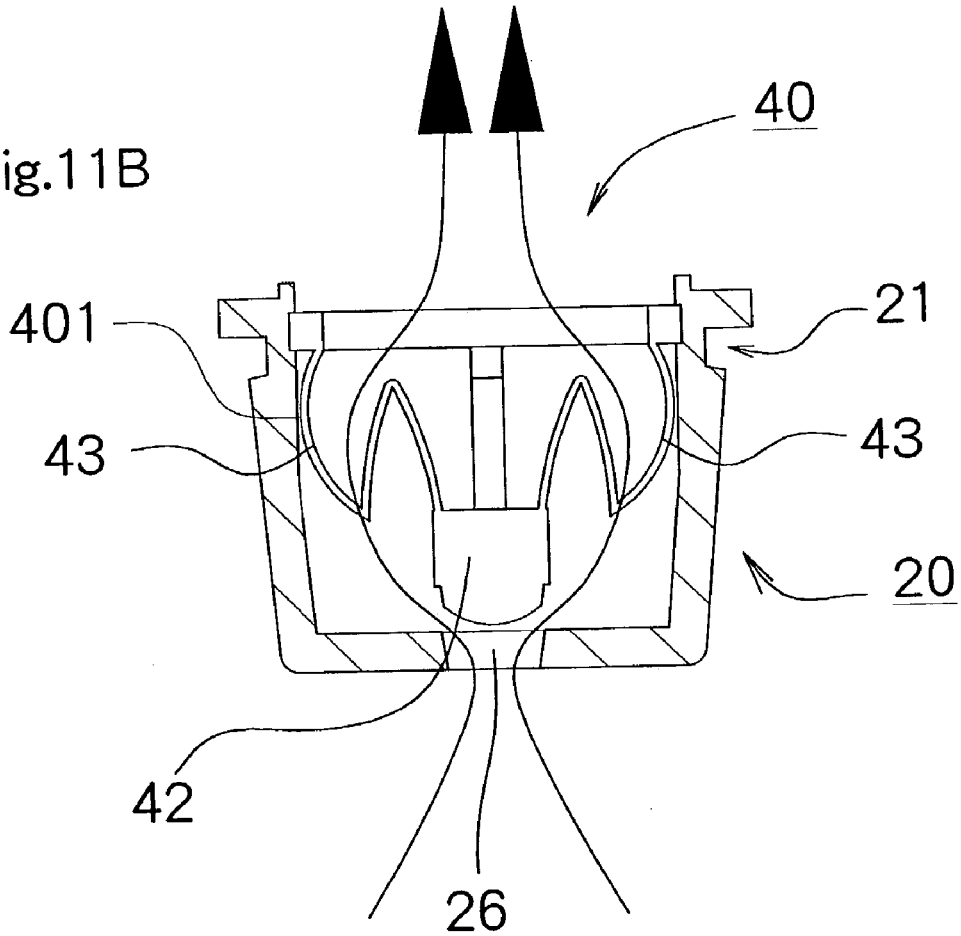

A configuration of the valve mechanism according to Embodiment 3 is described below. FIG. 10A and 10B are illustrations showing a valve portion 40 and a valve seat portion 20 comprising the valve mechanism according to Embodiment 3 of the present invention. FIG. 11A and 11B are sectional views showing the motion of the valve mechanism. Additionally, FIG. 10A shows a plan view of the valve portion 40; FIG. 10B shows a view that the valve portion 40 and the valve seat portion 20 are assembled. In FIG. 10B, a lateral view of the valve portion 40 and a sectional view of the valve seat portion 20 are shown.

In the valve mechanism according to this Embodiment 3, bending directions of flections 44 in four coupling portions 43 differ from bending directions of the flections 14 in the coupling materials 13 in the above-mentioned Embodiments 1 and 2. Additionally, when the same materials are used in this embodiment as those used in Embodiments 1 and 2, the same symbols are used and detailed descriptions of the materials are omitted.

The valve seat portion 20 of the valve mechanism according to Embodiment 3 has a valve seat portion having a nearly tubular shape, at the bottom of which a circular opening portion 26 which functions as a valve seat is formed. Upward inside this valve seat portion 20, a concave portion 25 is formed.

The valve portion 40 has a ring-shaped supporting portion 41 provided inside the valve seat portion 20, a valve body 42 having a shape corresponding to the circular opening portion 26 in the valve portion 20, and four coupling portions 43, which couple the supporting portion 41 and the valve body 42. The four coupling portions 43 have a pair of flections 44 respectively. In this valve portion 40, the valve body 42 is constructed in such a way that the valve body 42 can move between a closed position in which the valve body closes the opening portion 26 in the valve seat portion 20 and an open position in which the valve body opens the opening portion 26 by the flexibility of the four coupling portions 43.

As shown in FIGS. 11A and 11B, when the valve portion 40 is inserted inside the valve seat portion 20, the concave portion 25 in the valve seat portion 20 and the supporting portion 41 in the valve portion 40 engage with each other, and the valve portion 40 is fixed inside the valve seat portion 20. Additionally, the valve portion 40 and the valve seat portion 20 are produced by injection molding, etc. using synthetic resin such as polyethylene, etc.

In the valve mechanism having this configuration, when a pressure is applied to a fluid inside the fluid storing portion 142 by pressing the fluid storing portion 142 of the container main unit 140 shown in FIG. 1 to FIG. 4, the valve body 42 in the valve portion 40 moves to a separated position which is separated from the opening portion 26 in the valve seat portion 20. By this motion, the fluid passes through the opening portion 26. When the pressure applied to the fluid storing portion 142 is removed, by the elasticity recovering force of the four coupling portions 43, the valve body 42 in the valve portion 40 moves to the closed position in which the valve body closes the opening portion 26 in the valve seat portion 20. By this, intrusion of the air from the opening portion 26 to the fluid storing portion 142 can be prevented.

In this valve mechanism, a traveling distance of the valve body 42 changes according to a pressure applied to the fluid storing portion 142, i.e. a pressure applied to the valve mechanism, changing a flow rate of the fluid passing through the opening portion 26 discretionally becomes possible.

In this valve mechanism, in the same manner as in the valve mechanism according to Embodiments 1 and 2, when the valve body 42 moves from the closed position to the open position, the coupling portions 43 move in the direction in which they contact the inner walls of the valve seat portion 20. Consequently, when an inadequate tilt occurs in the valve body 42, the coupling portions 43 contact the inner walls of the valve seat portion 20, preventing the valve body 42 from tilting further.

Further, in this valve mechanism, four coupling portions 43 coupling the supporting portion 41 and the valve body 42 have a pair of flections 44 respectively. Consequently, these coupling portions 43 have appropriate elasticity, enabling the valve body 42 to reciprocate smoothly between the closed position and the open position.

Figure 12A:
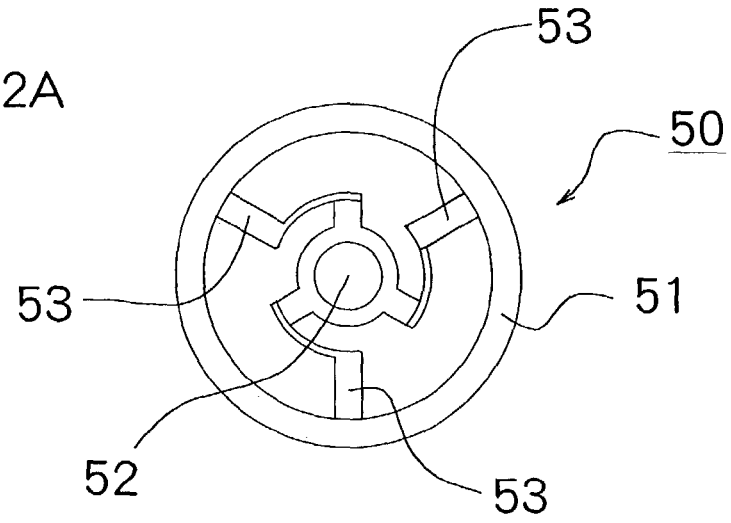
FIG. 12A and FIG. 12B are schematic diagrams showing the valve portion 50 and the valve seat portion 20 comprising the valve mechanism according to Embodiment 4 of the present invention.
Figure 12A:
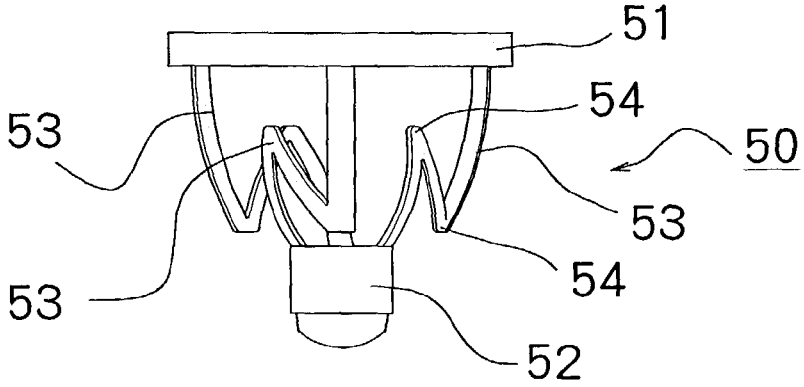
Figure 12B:
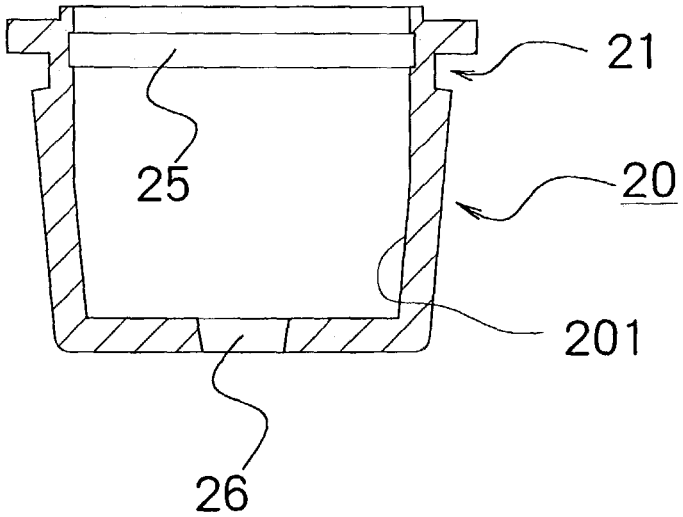
Figure 13A:
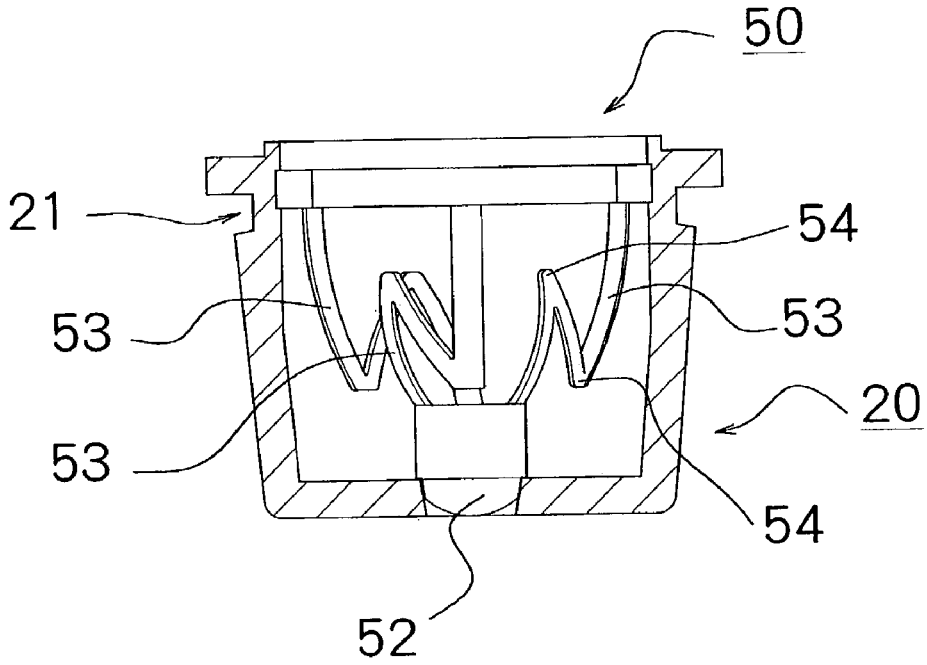
FIG. 13A and FIG. 13B are sectional views showing the motion of the valve mechanism according to Embodiment 4 of the present invention.
Figure 13B:
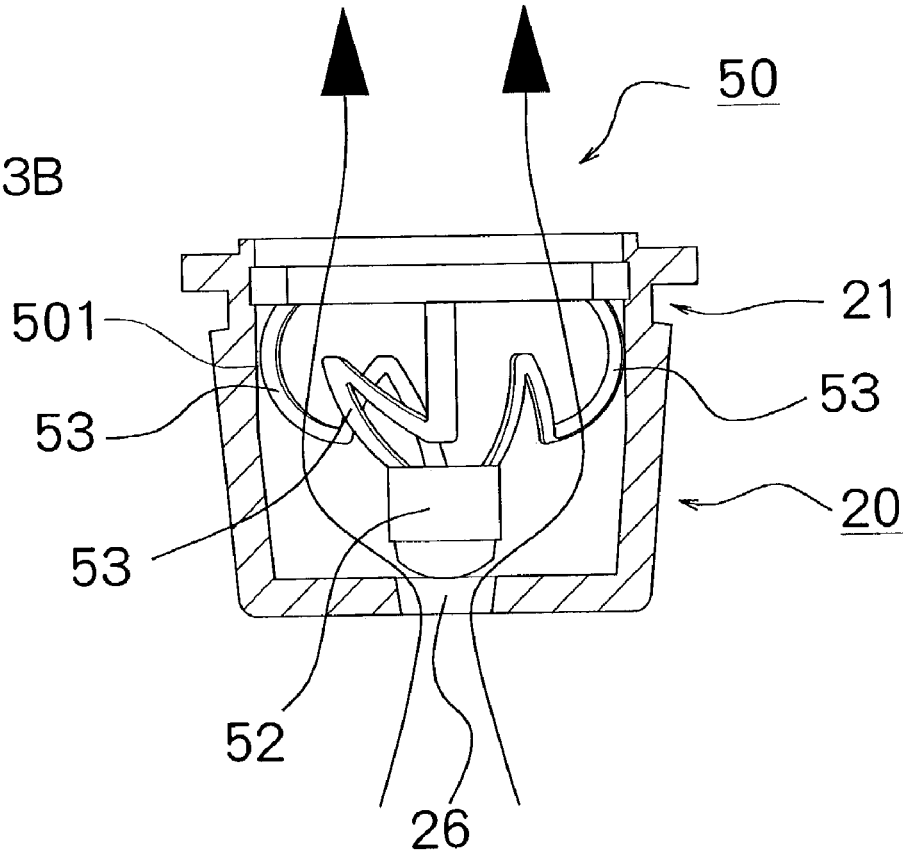

A configuration of the valve mechanism according to Embodiment 4 is described below. FIGS. 12A and 12B are illustrations showing a valve portion 50 and a valve seat portion 20 comprising the valve mechanism according to Embodiment 4 of the present invention. FIGS. 13A and 13B are sectional views showing the motion of the valve mechanism. Additionally, FIG. 12A shows a plan view of the valve portion 50; FIG. 12B shows a view that the valve portion 50 and the valve seat portion 20 are assembled. In FIG. 12B, a lateral view of the valve portion 50 and a sectional view of the valve seat portion 20 are shown.

While the four coupling portions 43 couple the supporting portion 41 and the valve body 42 in the above-mentioned Embodiment 3, three coupling portions 53 couple the supporting portion 51 and the valve body 52 in Embodiment 4. Additionally, when the same materials are used in this embodiment as those used in Embodiment 3, the same symbols are used and detailed descriptions of the materials are omitted.

In the valve mechanism according to this Embodiment 4, the valve portion 50 has the ring-shaped supporting portion 51 provided inside the valve seat portion 20, the valve body 52 having a shape corresponding to the circular opening portion 26 in the valve portion 20, and the three coupling portions 53, which couple the supporting portion 51 and the valve body 52. The three coupling portions 53 have a pair of flections 54 respectively. These pairs of flections 54 have different bending directions respectively. In this valve portion 50, the valve body 52 is constructed in such a way that the valve body 52 can move between a closed position in which the valve body closes the opening portion 26 in the valve seat portion 20 and an open position in which the valve body opens the opening portion 26 by the flexibility of the three coupling portions 53.

As shown in FIGS. 13A and 13B, when the valve portion 50 is inserted inside the valve seat portion 20, the concave portion 25 in the valve seat portion 20 and the supporting portion 51 in the valve portion 50 engage with each other, and the valve portion 50 is fixed inside the valve seat portion 20. Additionally, the valve portion 50 and the valve seat portion 20 are produced by injection molding, etc. using synthetic resin such as polyethylene, etc.

In the valve mechanism having this configuration, when a pressure is applied to a fluid inside the fluid storing portion 142 by pressing the fluid storing portion 142 of the container main unit 140 shown in FIG. 1 to FIG. 4, the valve body 52 in the valve portion 50 moves to a separated position which is separated from the opening portion 26 in the valve seat portion 20. By this motion, the fluid passes through the opening portion 26. When the pressure applied to the fluid storing portion 142 is removed, by the elasticity recovering force of the three coupling portions 53, the valve body 52 in the valve portion 50 moves to the closed position in which the valve body closes the opening portion 26 in the valve seat portion 20. By this, intrusion of the air from the opening portion 26 to the fluid storing portion 142 can be prevented.

In this valve mechanism, a traveling distance of the valve body 52 changes according to a pressure applied to the fluid storing portion 142, i.e. a pressure applied to the valve mechanism, changing a flow rate of the fluid passing through the opening portion 26 discretionally becomes possible.

In this valve mechanism, in the same manner as in the valve mechanism according to Embodiments 1, 2, and 3 when the valve body 52 moves from the closed position to the open position, the coupling portions 53 move in the direction in which they contact the inner walls of the valve seat portion 20. Consequently, when an inadequate tilt occurs in the valve body 52, the coupling portions 53 contact the inner walls of the valve seat portion 20, preventing the valve body 52 from tilting further.

Further, in this valve mechanism, the three coupling portions 53 coupling the supporting portion 51 and the valve body 52 have a pair of flections 54 respectively. Consequently, these coupling portions 53 have appropriate elasticity, enabling the valve body 52 to reciprocate smoothly between the closed position and the open position.

Figure 14A:
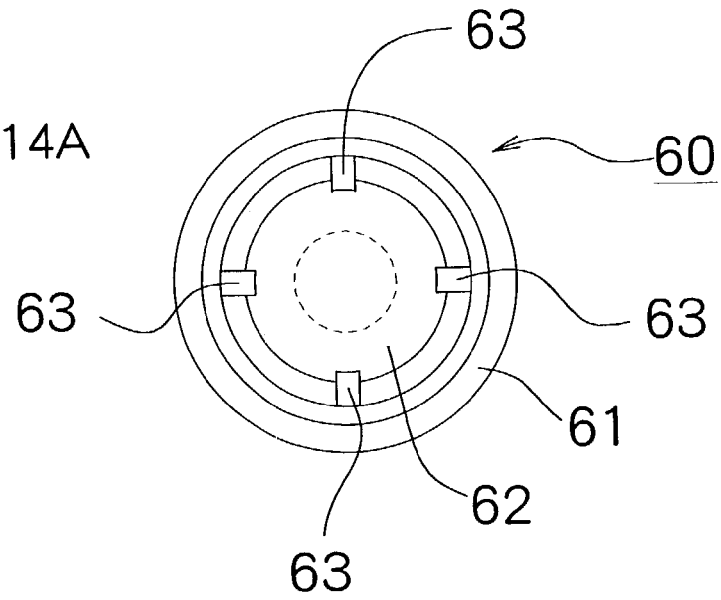
FIG. 14A and FIG. 14B are schematic diagrams showing the valve portion 60 and the valve seat portion 20 comprising the valve mechanism according to Embodiment 5 of the present invention.
Figure 14A:
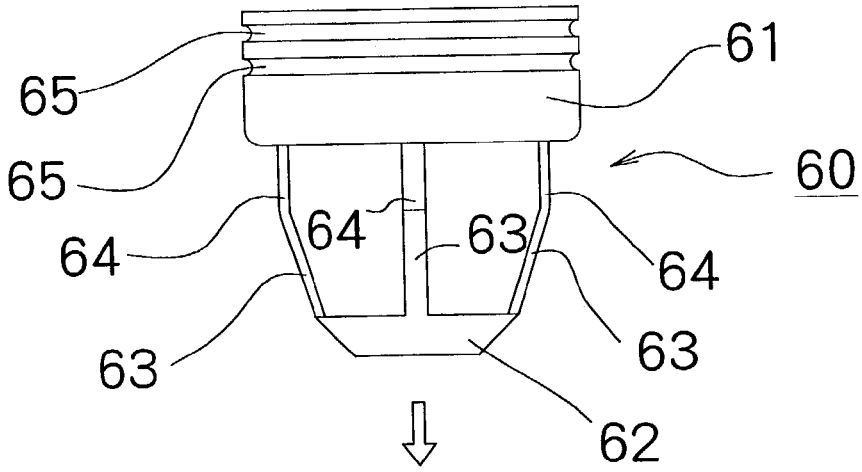
Figure 14B:
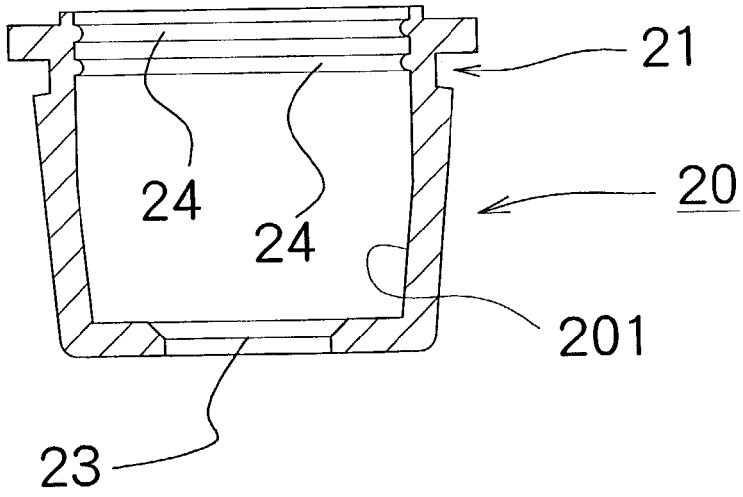
Figure 15A:
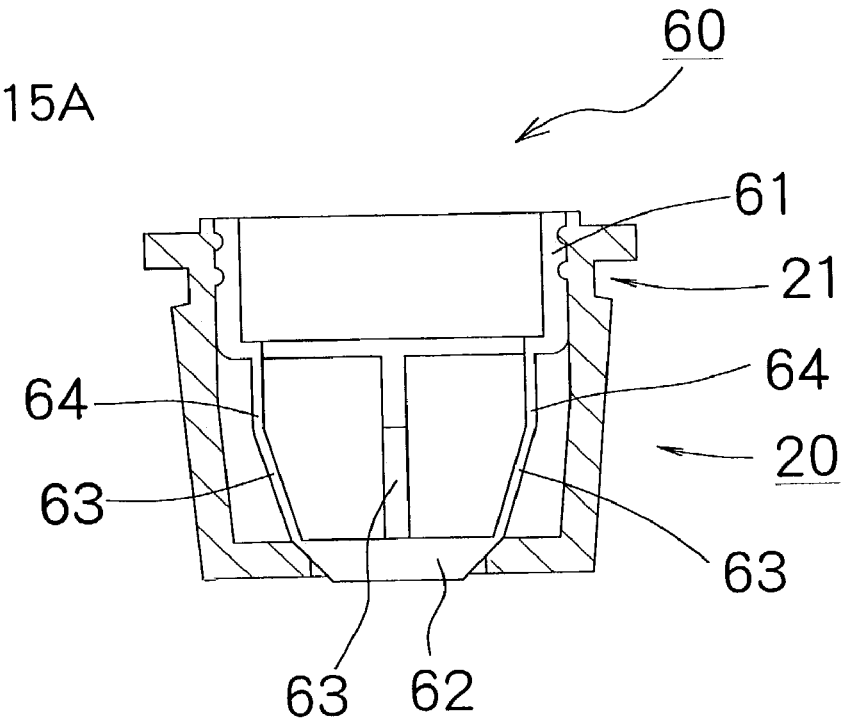
FIG. 15A and FIG. 15B are sectional views showing the motion of the valve mechanism according to Embodiment 5 of the present invention.
Figure 15B:
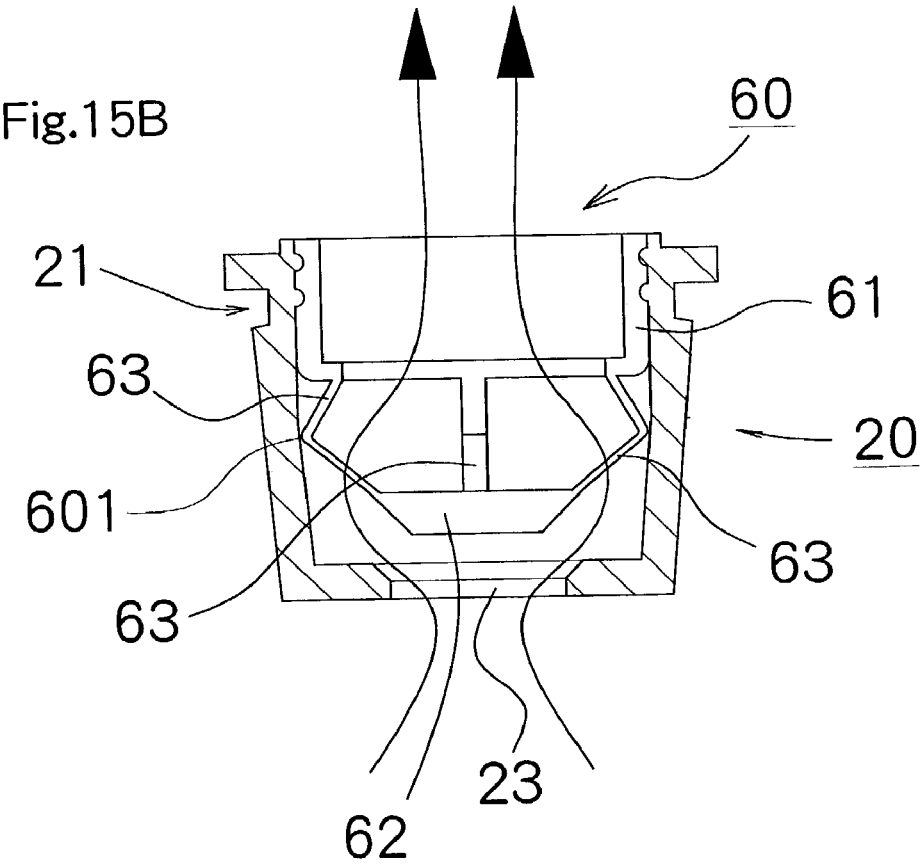

A configuration of the valve mechanism according to Embodiment 5 is described below. FIGS. 14A and 14B are illustrations showing a valve portion 60 and a valve seat portion 20 comprising the valve mechanism according to Embodiment 5 of the present invention. FIGS. 15A and 15B are sectional views showing the motion of the valve mechanism. Additionally, FIG. 14A shows a plan view of the valve portion 60; FIG. 14B shows a view that the valve portion 60 and the valve seat portion 20 are assembled. In FIG. 14, a lateral view of the valve portion 60 and a sectional view of the valve seat portion 20 are shown.

While respective coupling portions 13, 43 and 53 in the above-mentioned Embodiments 1 to 4 have multiple flections 14, 44 and 54, respective coupling portions have a single flection 64 in the valve mechanism according to Embodiment 5.

In this valve mechanism, in the same manner as in the valve mechanism according to Embodiments 1 to 4, when the valve body 62 moves from a closed position to an open position, the coupling portions 63 move in the direction in which they contact the inner walls of the valve seat portion 20. Consequently, when an inadequate tilt occurs in the valve body 62, the coupling portions 63 contact the inner walls of the valve seat portion 20, preventing the valve body 62 from tilting further.

Because the motion of the valve mechanism according to Embodiment 5 is the same as that of the valve mechanisms according to Embodiments 1 to 4, the detailed description for the motion is omitted.

Figure 16A:
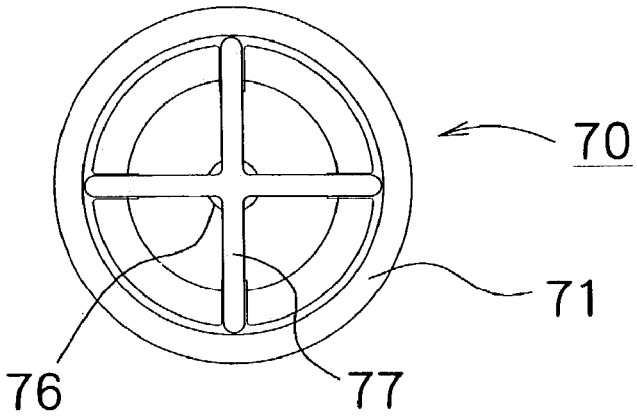
FIG. 16A and FIG. 16B are schematic diagrams showing the valve portion 70 and the valve seat portion 20 comprising the valve mechanism according to Embodiment 6 of the present invention.
Figure 16A:
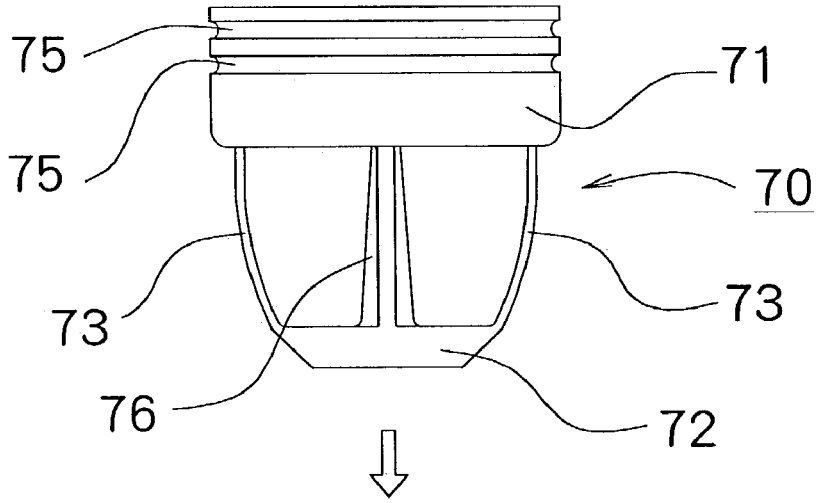
Figure 16B:
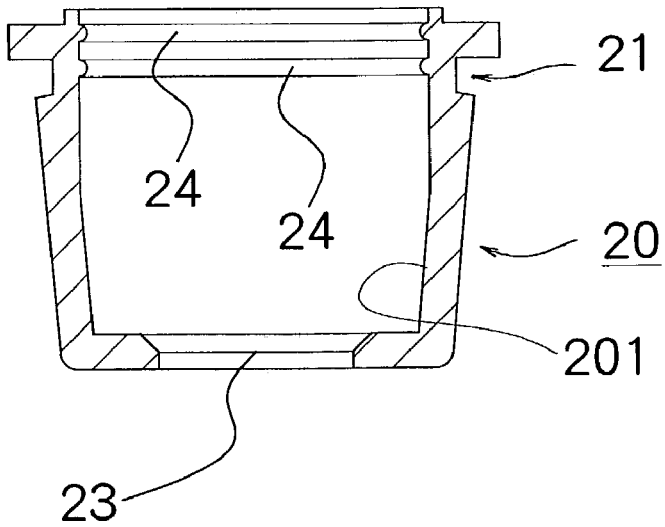
Figure 17A:
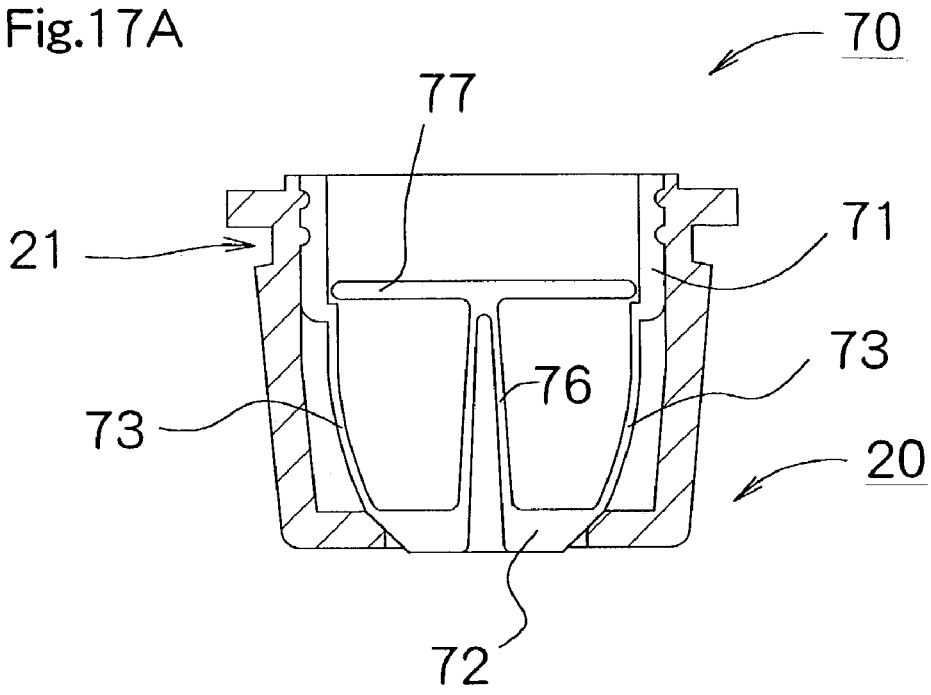
FIG. 17A and FIG. 17B are sectional views showing the motion of the valve mechanism according to Embodiment 6 of the present invention.
Figure 17B:
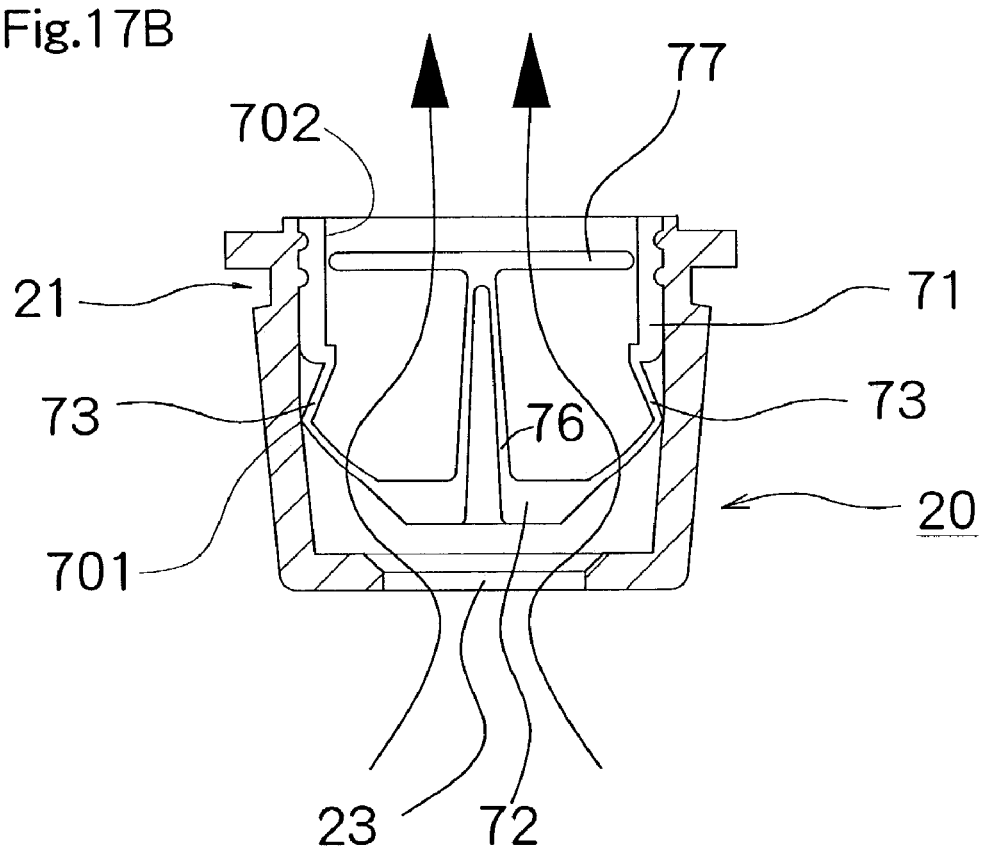

A configuration of the valve mechanism according to Embodiment 6 is described below. FIGS. 16A and 16B are illustrations showing a valve portion 70 and a valve seat portion 20 comprising the valve mechanism according to Embodiment 5 of the present invention. FIGS. 17A and 17B are sectional views showing the motion of the valve mechanism. Additionally, FIG. 16A shows a plan view of the valve portion 70; FIG. 16B shows a view that the valve portion 70 and the valve seat portion 20 are assembled. In FIG. 16B, a lateral view of the valve portion 70 and a sectional view of the valve seat portion 20 are shown. Additionally, when the same materials are used in this embodiment as those used in Embodiments 1 and 2, the same symbols are used and detailed descriptions of the materials are omitted.

The valve portion 70 in the valve mechanism according to Embodiment 6 has a ring-shaped supporting portion 71 provided inside the valve seat portion 20, a valve body 72 having a shape corresponding to the circular opening portion 23 in the valve portion 20, and four coupling portions 73, which couple the supporting portion 71 and the valve body 72. In this valve portion 70, the valve body 72 is constructed in such a way that the valve body 72 can move between a closed position in which the valve body closes the opening portion 23 in the valve seat portion 20 and an open position in which the valve body opens the opening portion 23 by the flexibility of the four coupling portions 73.

As shown in FIGS. 17A and 17B, when the valve portion 70 is inserted inside the valve seat portion 20, a convex portion 24 formed in the valve seat portion 20 and the concave portion 75 formed in the supporting portion 71 in the valve portion 70 engage with each other, and the valve portion 70 is fixed inside the valve seat portion 20. Additionally, the valve portion 70 and the valve seat portion 20 are produced by injection molding, etc. using synthetic resin such as polyethylene, etc.

In the valve mechanism having this configuration, when a pressure is applied to a fluid inside the fluid storing portion 142 by pressing the fluid storing portion 142 of the container main unit 140 shown in FIG. 1 to FIG. 4, the valve body 72 in the valve portion 70 moves to a separated position which is separated from the opening portion 23 in the valve seat portion 20. By this motion, the fluid passes through the opening portion 23. When the pressure applied to the fluid storing portion 142 is removed, by the elasticity recovering force of the four coupling portions 73, the valve body 72 in the valve portion 70 moves to the closed position in which the valve body closes the opening portion 23 in the valve seat portion 20. By this, intrusion of the air from the opening portion 23 to the fluid storing portion 142 can be prevented.

In this valve mechanism, a traveling distance of the valve body 72 changes according to a pressure applied to the fluid storing portion 142, i.e. a pressure applied to the valve mechanism, changing a flow rate of the fluid passing through the opening portion 23 discretionally becomes possible.

In this valve mechanism, in the same manner as in the valve mechanism according to Embodiments 1 and 5, when the valve body 72 moves from the closed position to the open position, the coupling portions 73 move in the direction in which they contact the inner walls of the valve seat portion 20. Consequently, when an inadequate tilt occurs in the valve body 72, the coupling portions 73 contact the inner walls of the valve seat portion 20, preventing the valve body 72 from tilting further.

In this valve mechanism, a coupling material 76 is set up by standing it above the valve body 72; on the upper end of this coupling material 76, a guide plate 77 is provided. An outside diameter of this guide plate 77 is slightly smaller than an inside diameter of the supporting portion 71. Because of this, when an inadequate tilt occurs in the valve body 72, the guide plate 77 contacts the inner walls of the valve seat portion 20, preventing further tilting of the valve body 72. This enables to prevent occurrence of an inadequate tilt in the valve body 72 more reliably.

Figure 18A:
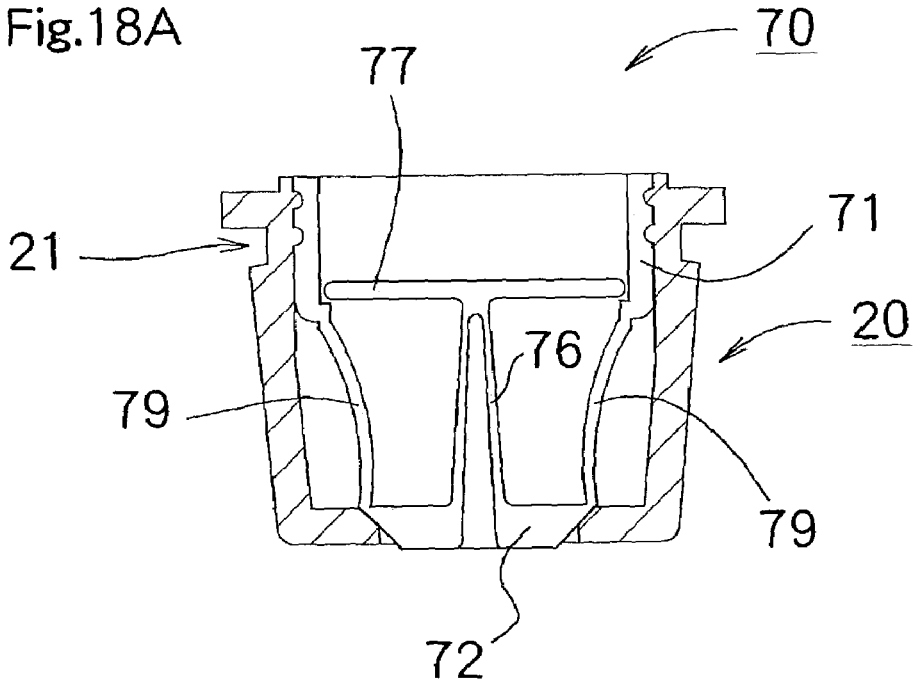
FIG. 18A and FIG. 18B are sectional views showing the motion of the valve mechanism according to Embodiment 7.
Figure 18B:
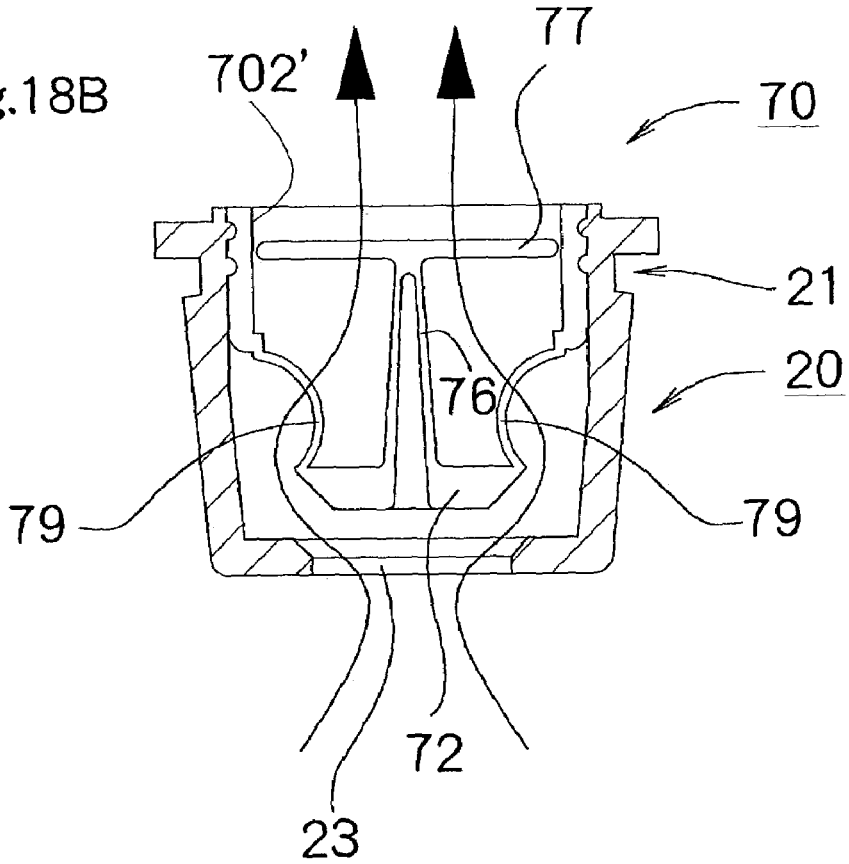
Figure 19A:
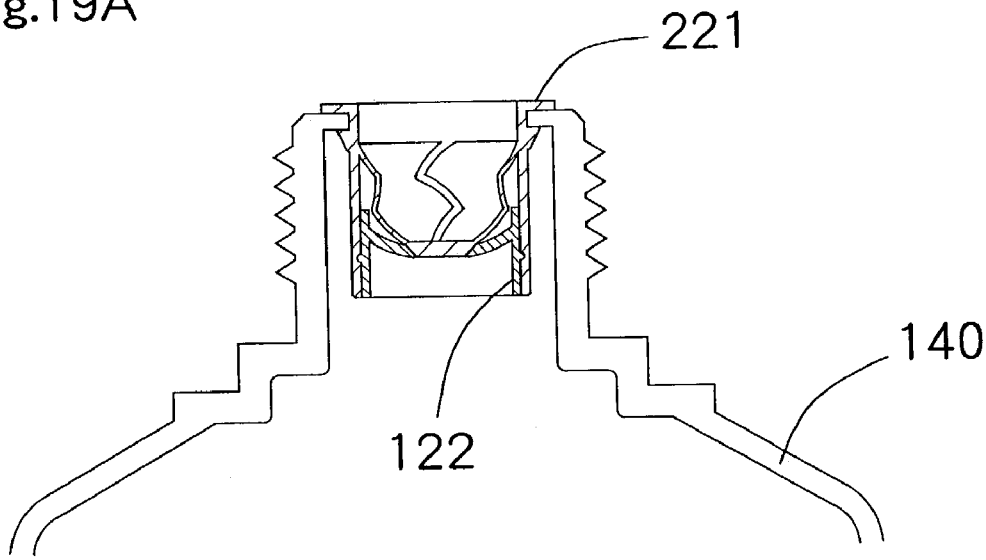
FIG. 19A and FIG. 19B are enlarged views showing the relevant part of the tube-type container to which the valve mechanism according to Embodiment 8 of the present invention applies.
Figure 19B:
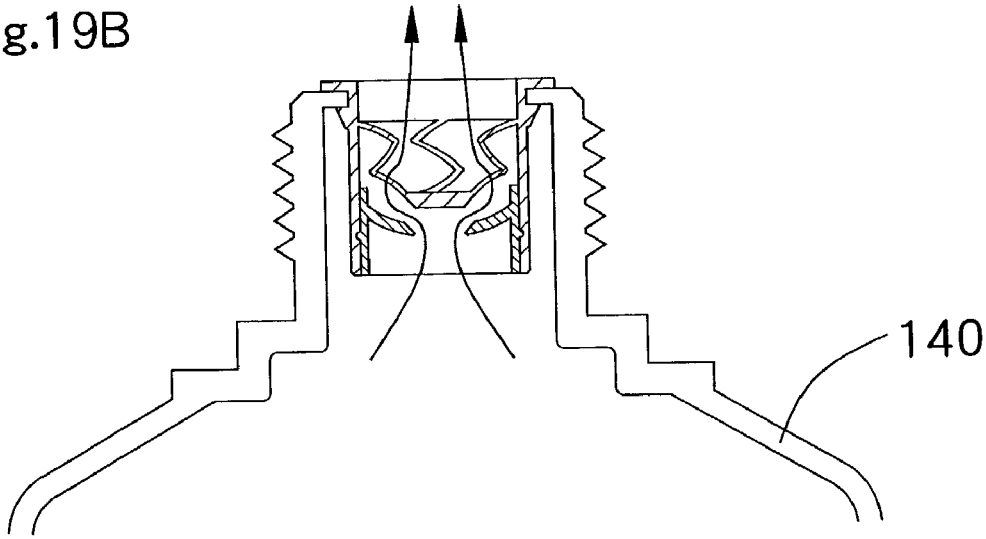
Figure 20A:
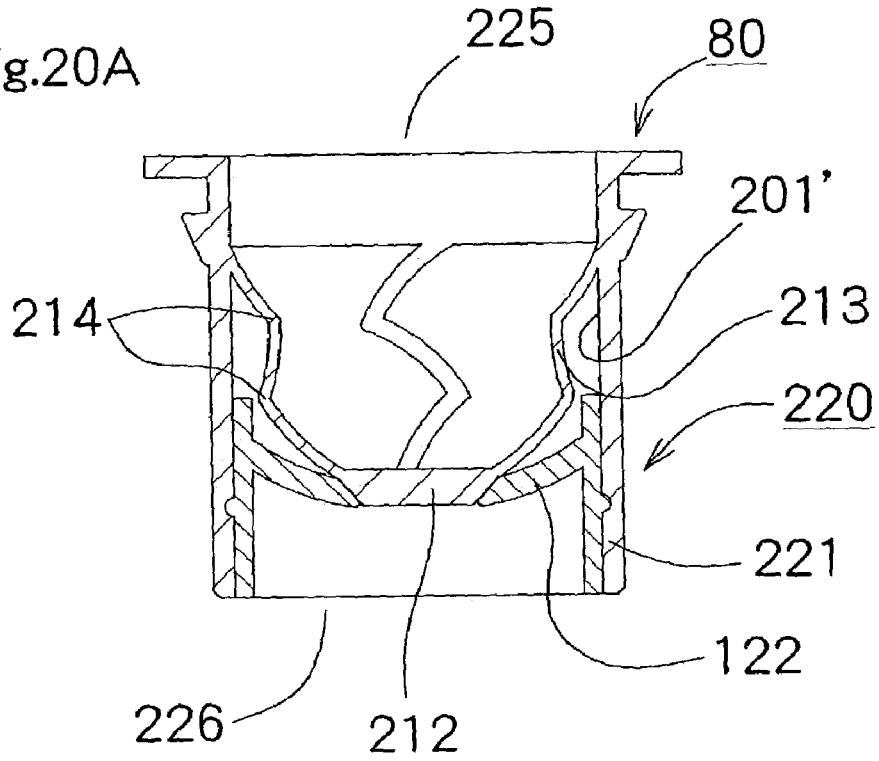
FIG. 20A and FIG. 20B are sectional views showing the motion of the valve mechanism according to Embodiment 8 of the present invention.
Figure 20B:
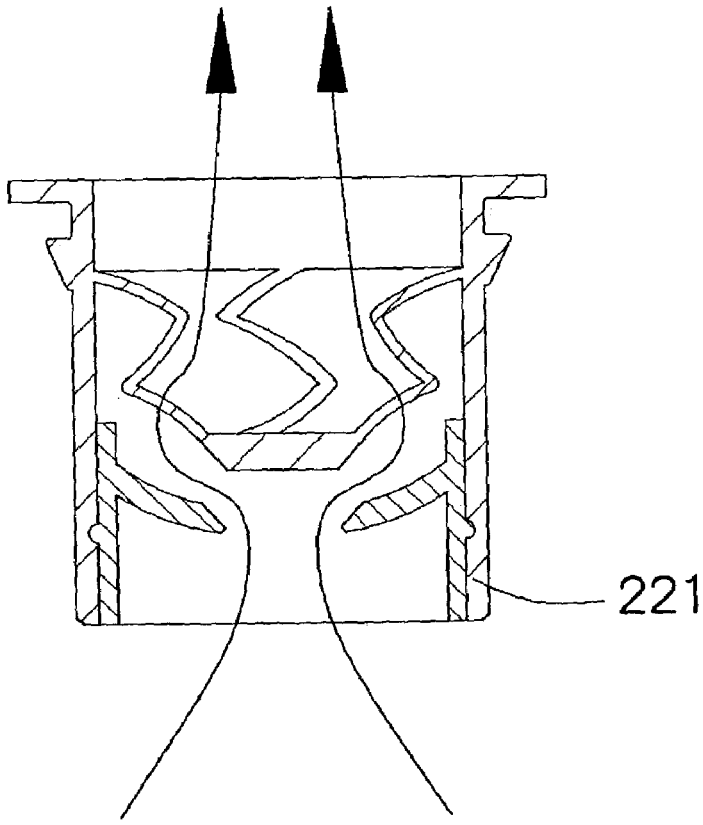
Figure 21A:
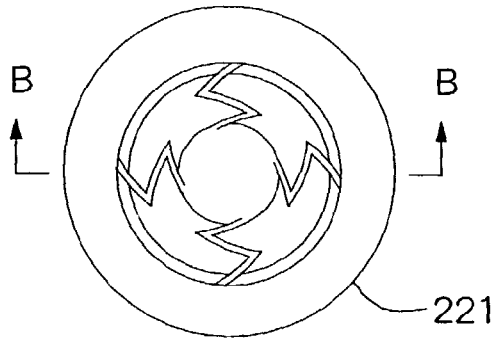
FIG. 21A, FIG. 21B, FIG. 21C, and FIG. 21D are schematic diagrams showing the valve portion and the valve seat portion according to Embodiment 8 of the present invention.
Figure 21B:
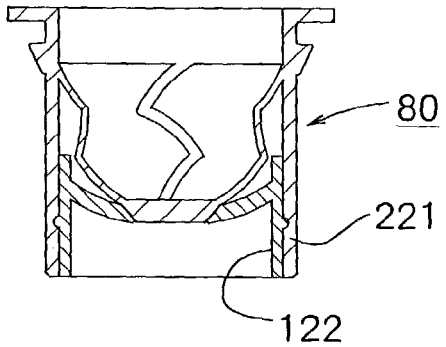
Figure 21C:
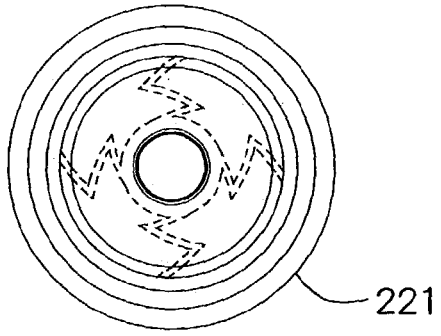
Figure 21D:
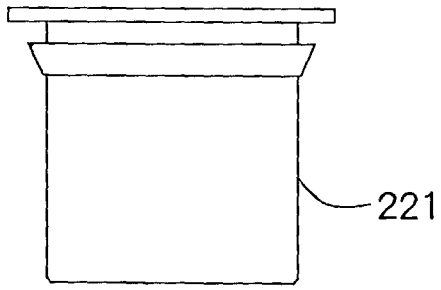
Figure 22A:
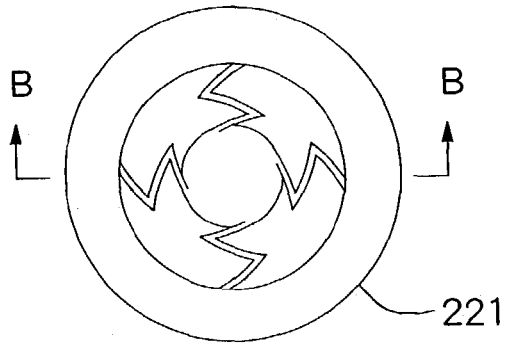
FIG. 22A, FIG. 22B, FIG. 22C, and FIG. 22D are schematic diagrams showing the cylindrical support with the valve body according to Embodiment 8 of the present invention.
Figure 22B:
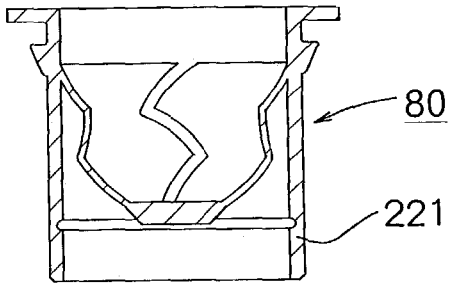
Figure 22C:
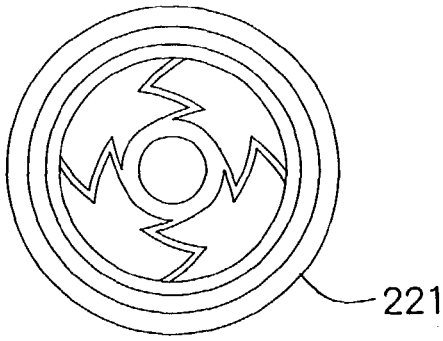
Figure 22D:
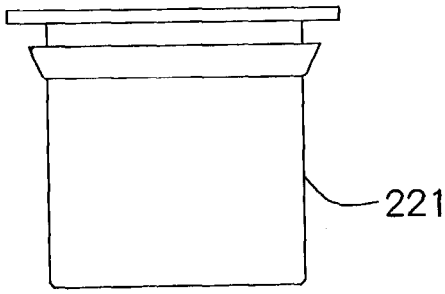
Figure 23A:
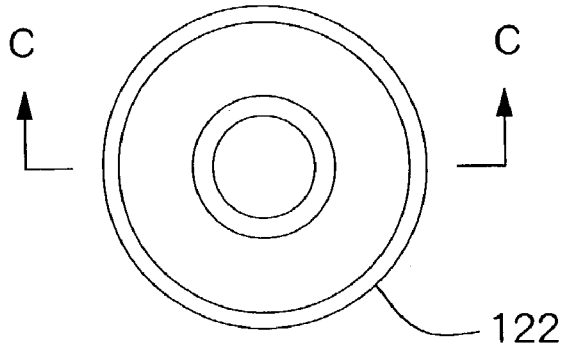
FIG. 23A, FIG. 23B, FIG. 23C, and FIG. 23D are schematic diagrams showing the valve seat according to Embodiment 8 of the present invention.
Figure 23B:
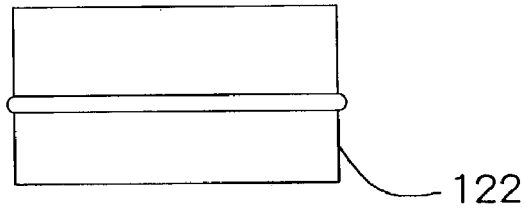
Figure 23C:
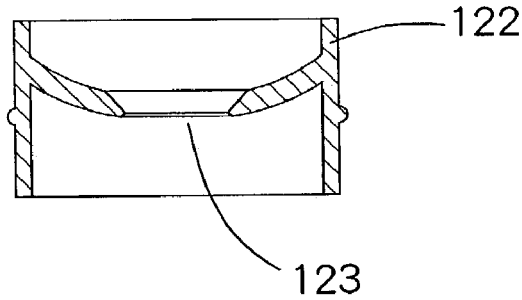
Figure 23D:
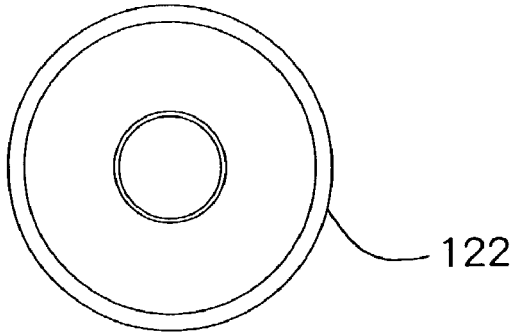

When this guide mechanism comprising the coupling material 76 and the guide plate 77 is provided, it is not necessary to adopt a configuration in which the coupling portions 73 moves in the direction of contacting inner walls of the valve seat portion 20 when the valve body 72 moves from the closed position to the open position. FIGS. 18A and 18B are sectional views showing the motion of this valve mechanism according to Embodiment 7. Additionally, when the same materials are used in this embodiment as those used in Embodiment 6, the same symbols are used and detailed descriptions of the materials are omitted.

In this valve mechanism according to Embodiment 7, as four coupling portions 79 coupling the supporting portion 71 in the valve portion 70, a configuration, in which the coupling portions 79 move in the direction-separating from the inner walls of the valve seat portion 20 when the valve body 72 moves from the closed position to the open position, is adopted. Even when this configuration is adopted, by the action of a guide mechanism comprising the coupling material 76 and the guide plate 77, occurrence of an inadequate tilt in the valve body 72 can be prevented.

Additionally, in respective embodiments mentioned above, the modes in which the valve mechanism according to the present invention applies to tube-type fluid containers were described. The present invention, however, also can be applied to, for example, fluid discharge pumps used for fluid storing containers, etc.

Furthermore, in respective embodiments mentioned above, the present invention is applied to the valve mechanism used for fluids. The present invention, however, can be applied to the valve mechanism used for gases. In this case, as a material for respective coupling portions 13, 43, 53, 63, 73 and 79, a material with high rigidity is used so that stronger momentum is given to respective valve bodies 12, 42, 52, 62 and 72 in the direction of the opening portions 23 and 26.

FIG. 19A through FIG. 23D show Embodiment 8 of the present invention which can be applied in combination with any of the foregoing embodiments. In this embodiment, as shown ink FIGS. 20A and 20B and FIGS. 21A to 21D, a valve mechanism comprises: a cylindrical support 221 having an upper opening 225 and a lower opening 226, through which a fluid passes; a valve seat portion 220 having an opening 123 at its bottom through which the fluid passes; and a resinous valve portion 80 comprising: (i) a valve body 212 having a shape corresponding to the opening of the valve seat 123; and (ii) multiple connectors 213 connecting the valve body 212 to an inner wall 201' of the cylindrical support 221. The connectors 213 elastically urge the valve body 212 downward to close the opening 123 and is bendable as the valve body 212 moves upward. The valve seat portion 122 is fitted in inside the lower opening of the cylindrical support 221. In the previous embodiments, the valve seat portion is a single integrated piece, and the valve body is a separate piece. However, in this embodiment, the valve seat portion 220 is comprised of different pieces (i.e., the valve seat 122 and a lower part of the cylindrical support 221), and the valve portion 80 is a single piece including the valve body 212, connectors 213, and an upper part of the cylindrical support 221. Thus, in this embodiment, the cylindrical support is both a part of the valve seat portion 220 and a part of the valve portion 80 (FIGS. 22A–22D and FIGS. 23A–23D).

When configuring the valve seat to be a separate piece from the cylindrical support and be fitted in the lower opening of the cylindrical support, and/or when forming the valve body, the connectors, and the cylindrical support as an integrated single piece, influence by plastic deformation caused during manufacturing processes (e.g., inflation molding) can be reduced, improving sealability between the valve body and the valve seat and improving assembly operation.

The closing and opening operation is the same as in the previous embodiments. Although this embodiment does not show connectors which are in contact with an inner wall of the cylindrical support, such connectors can be used as in the previous embodiments. Thus, the connectors may comprise at least three coupling portions, and may have flections.

Figure 24:
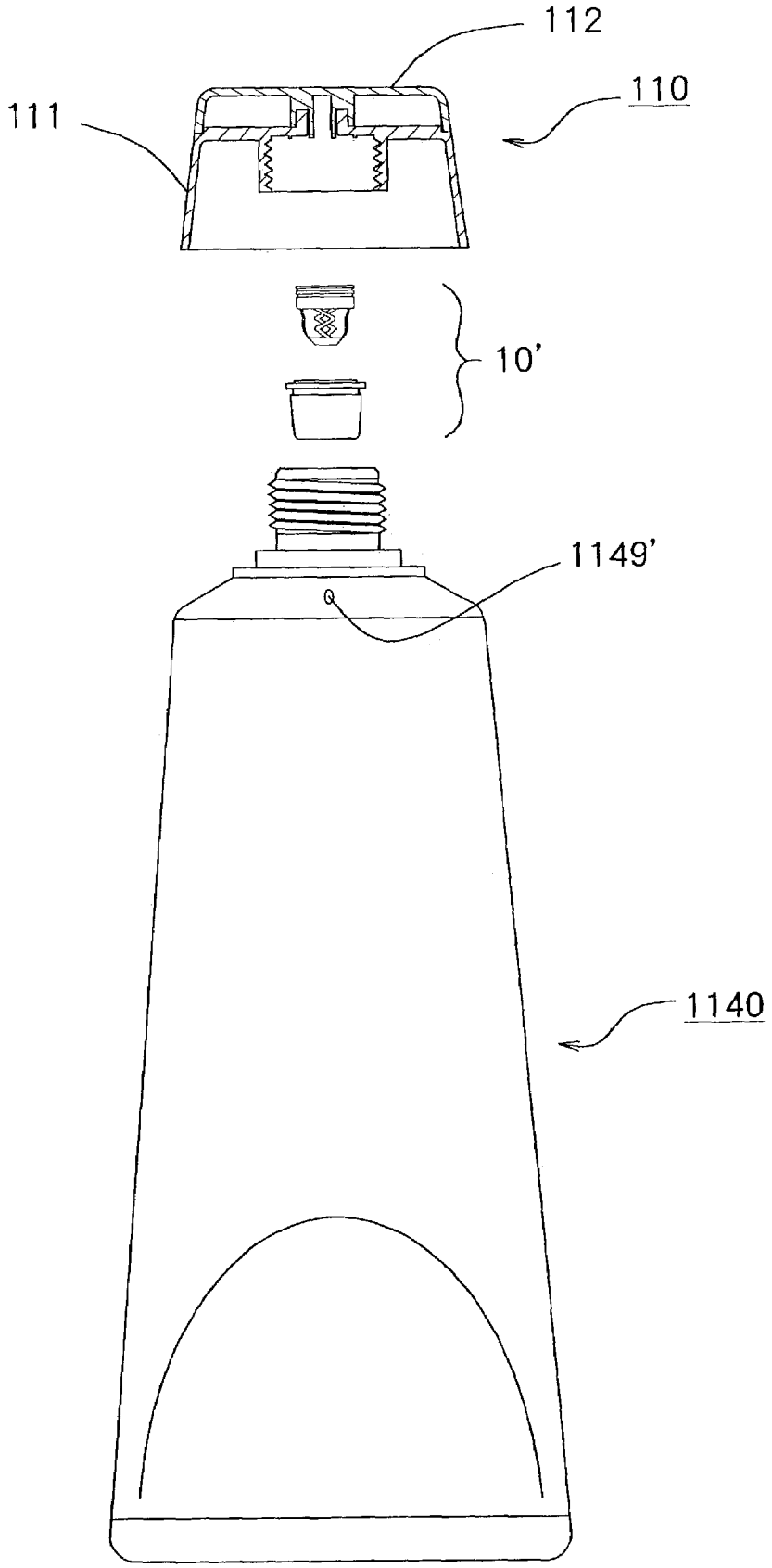
FIG. 24 is a front view of the tube-type container according to an embodiment of the present invention.
Figure 25:
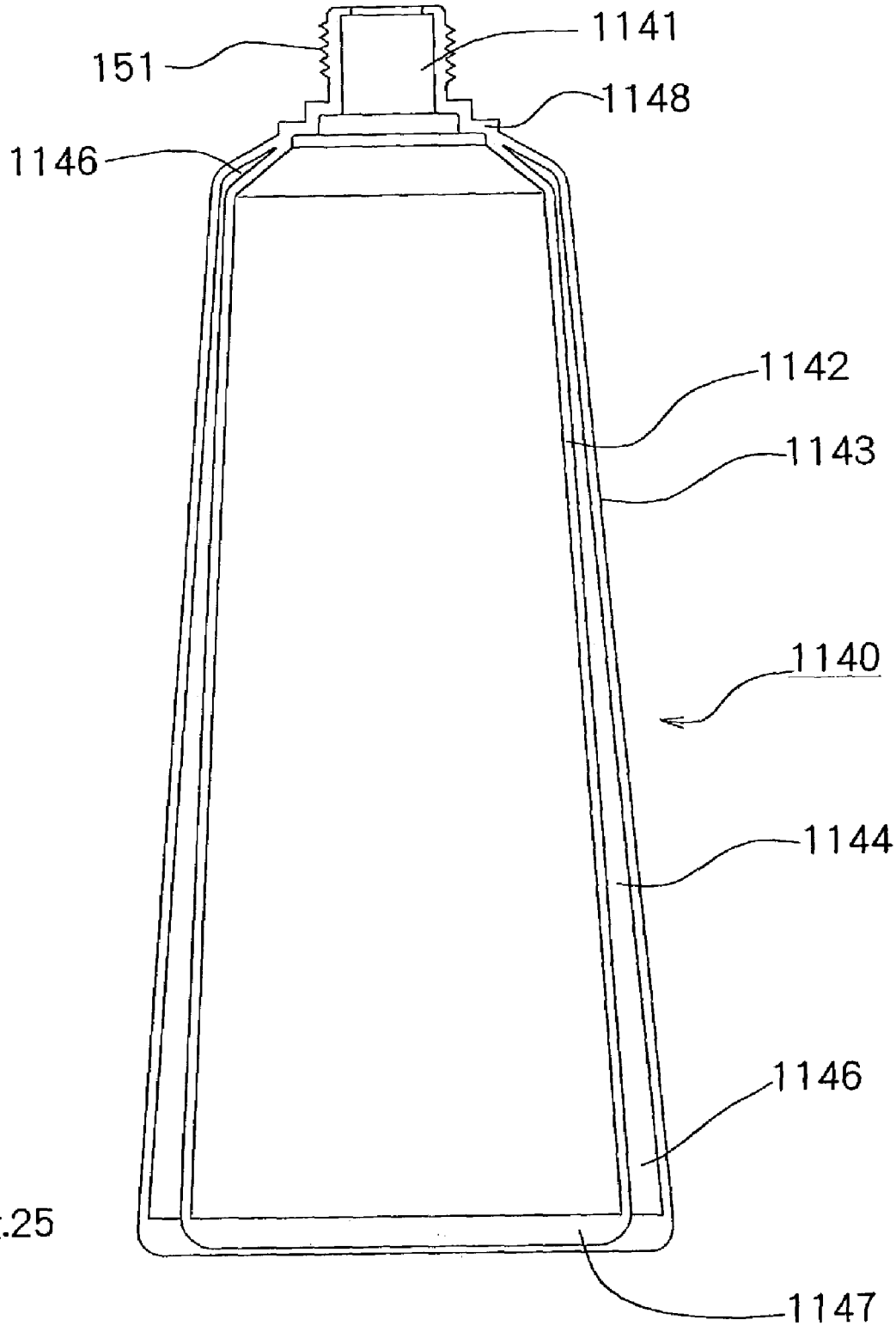
FIG. 25 is a longitudinal section of the tube-type container without a fluid and a valve mechanism according to an embodiment of the present invention.

Another preferred embodiment of the present invention is described with referent to the drawings. FIG. 24 is a front view of the tube-type fluid container according to Embodiment 9 of the present invention. FIG. 25 is its longitudinal section (without a valve mechanism or a fluid).

This tube-type container is used as a container for beauty products for storing gels such as hair gels and cleansing gels or creams such as nourishing creams and cold creams used in the cosmetic field. Additionally, this tube-type container also can be used as a container for medicines, solvents or foods, etc.

This tube-type container possesses a container main unit 1140, a lid material 110 which is placed at the top of the container main unit 1140, and a valve mechanism 10'.

Figure 26:
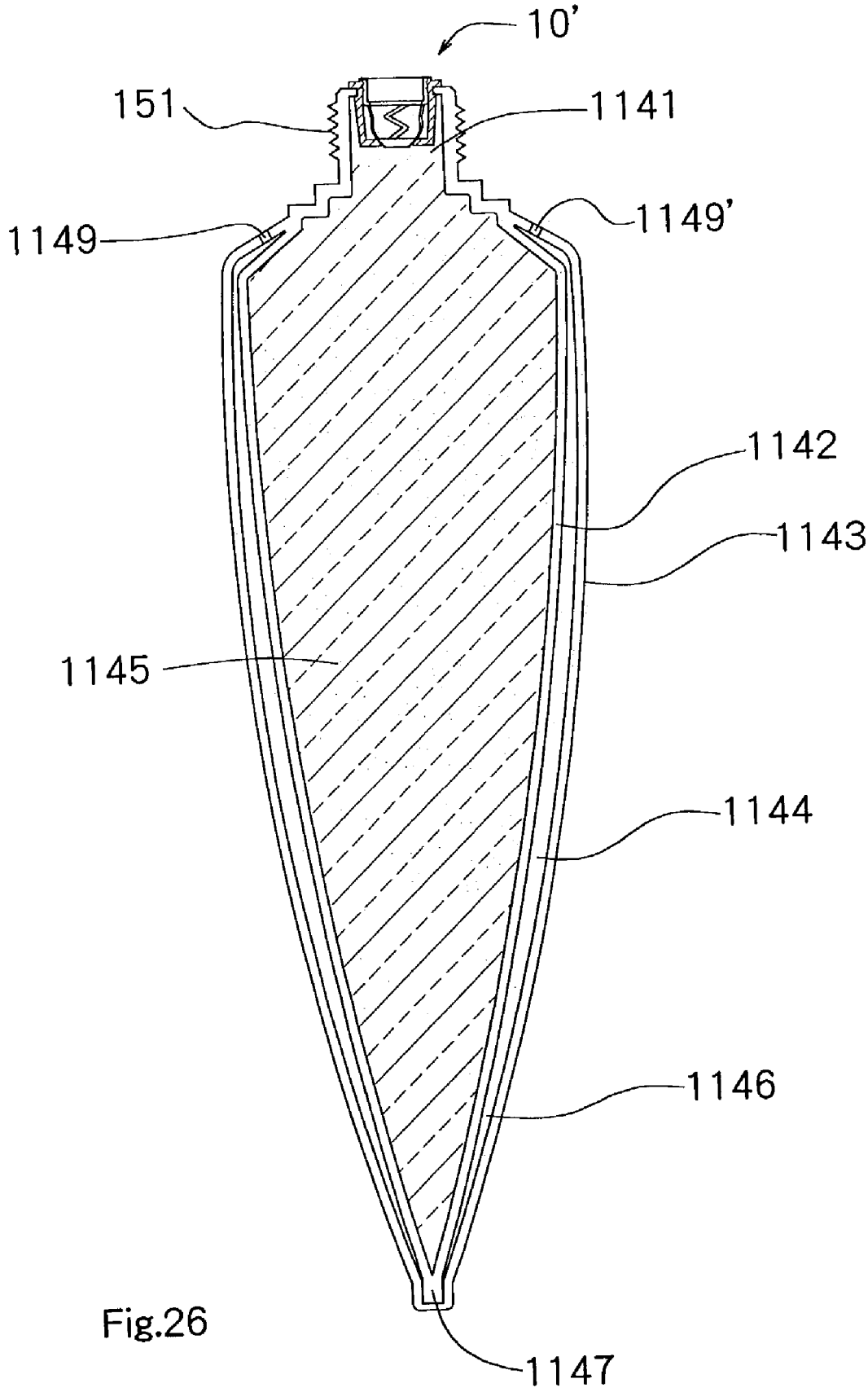
FIG. 26 is a lateral section showing a position before a pressure is applied to the tube-type fluid container according to Embodiment 9 of the present invention, from which the lid material 110 is omitted.
Figure 27:
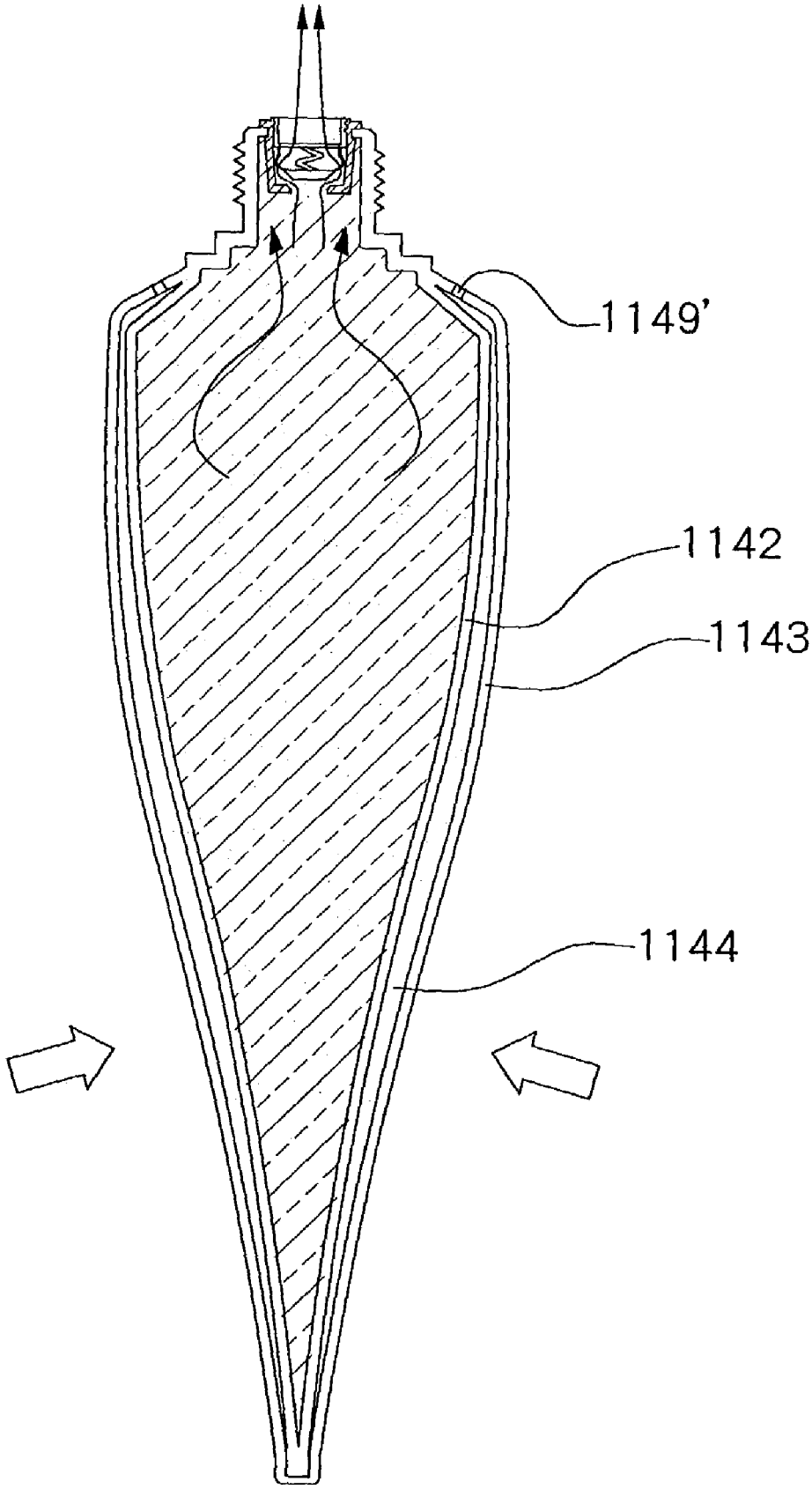
FIG. 27 is a lateral section showing a position when a pressure is applied to the tube-type fluid container according to Embodiment 9 of the present invention, from which the lid material 110 is omitted.
Figure 28:
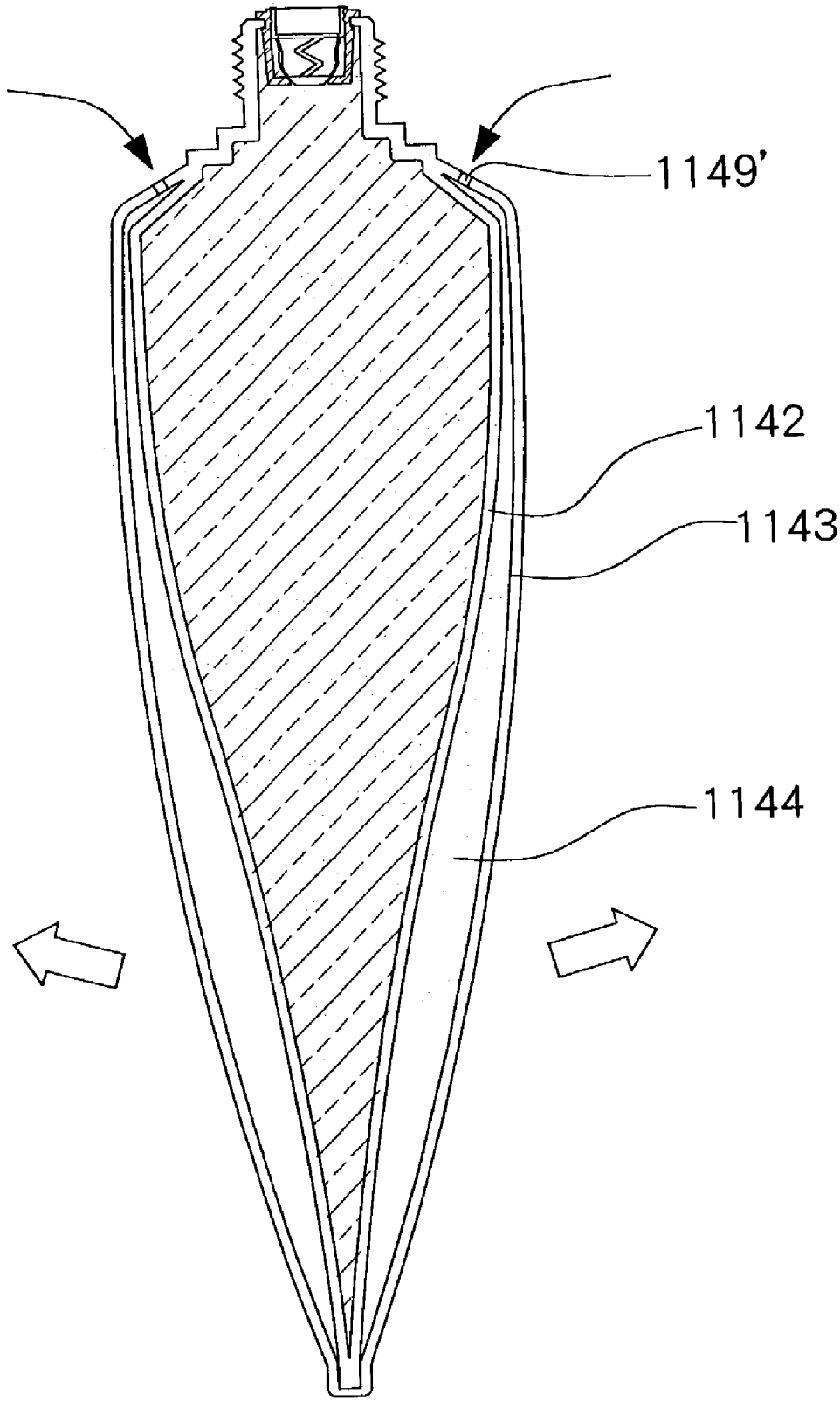
FIG. 28 is a lateral section showing a position when a shape of the external container 143 in the tube-type fluid container according to Embodiment 9 of the present invention is restored, from which the lid material 110 is omitted.

A configuration of the container main unit 1140 of the tube-type fluid container according to Embodiment 9 of the present invention is described below. FIG. 26 is a lateral section showing a position before a pressure is applied to the tube-type fluid container according to Embodiment 9 of the present invention, from which the lid material 110 is omitted. FIG. 27 is a lateral section showing a position when a pressure is applied to the tube-type fluid container according to Embodiment 9 of the present invention, from which the lid material 110 is omitted. FIG. 28 is a lateral section showing a position when a shape of the external container 1143 in the tube-type fluid container according to Embodiment 9 of the present invention is restored, from which the lid material 110 is omitted.

The container main unit 1140 possesses an internal container 1142 storing a fluid and an external container 1143 encompassing the internal container 1142. An internal space 1144 which is shut off from the outside is formed between the internal container 1142 and the external container 1143.

The external container 1143 in this container main unit 1140 has a configuration comprising synthetic resin alone or a lamination of synthetic resin and aluminum, and has an elasticity recovering force which tries to recover its original shape when a pressure applied to it is removed. Further, in the external container 1143, a hole 1149' which communicates with the interior space and the outside is formed. This hole 1149' formed in the external container has a size (including 0.1–3 mm, 0.5–2 mm) which can let a small amount of air through. One or more holes 1149' can be formed (including 2, 3, or 4 holes).

When a pressure is applied to the container main unit 1140 from the position shown in FIG. 26, in which the pressure is not applied, as shown in FIG. 27, the volume of the external container 1143 reduces as the volume of the internal container 1142 reduces by outflow of the fluid inside the internal container 1142. At this time, by the elasticity recovering force of the external container 1143, inside the internal space 1144 which is shut off from the outside is depressurized. Consequently, as shown in FIG. 28, an amount of the air corresponding to the reduced volume of the external container 1143 flows into the internal space 1144 from the hole formed in the external container 1143, which communicates with the internal space 1144 and the outside, restoring the external container 1143 to its original shape before the pressure has been applied.

Because this hole 1149' has a size which can let a slight amount of the air through, an outflow of the air from the internal space 1144 to the outside can be controlled to be small. Consequently, it becomes possible to apply a right pressure to the fluid inside the internal container 1142.

The internal container 1142 and the external container 1143 are both formed/shaped by blow molding, and then an opening portion 1145 of the internal container and an opening portion 1146 of the external container are connected each other at the welding portion 1148 on the discharge port side of the container main unit 1140 and are welded at a welding portion 1147 on the bottom side. Consequently, it becomes possible to manufacture tube-type fluid containers at low costs.

Figure 29:
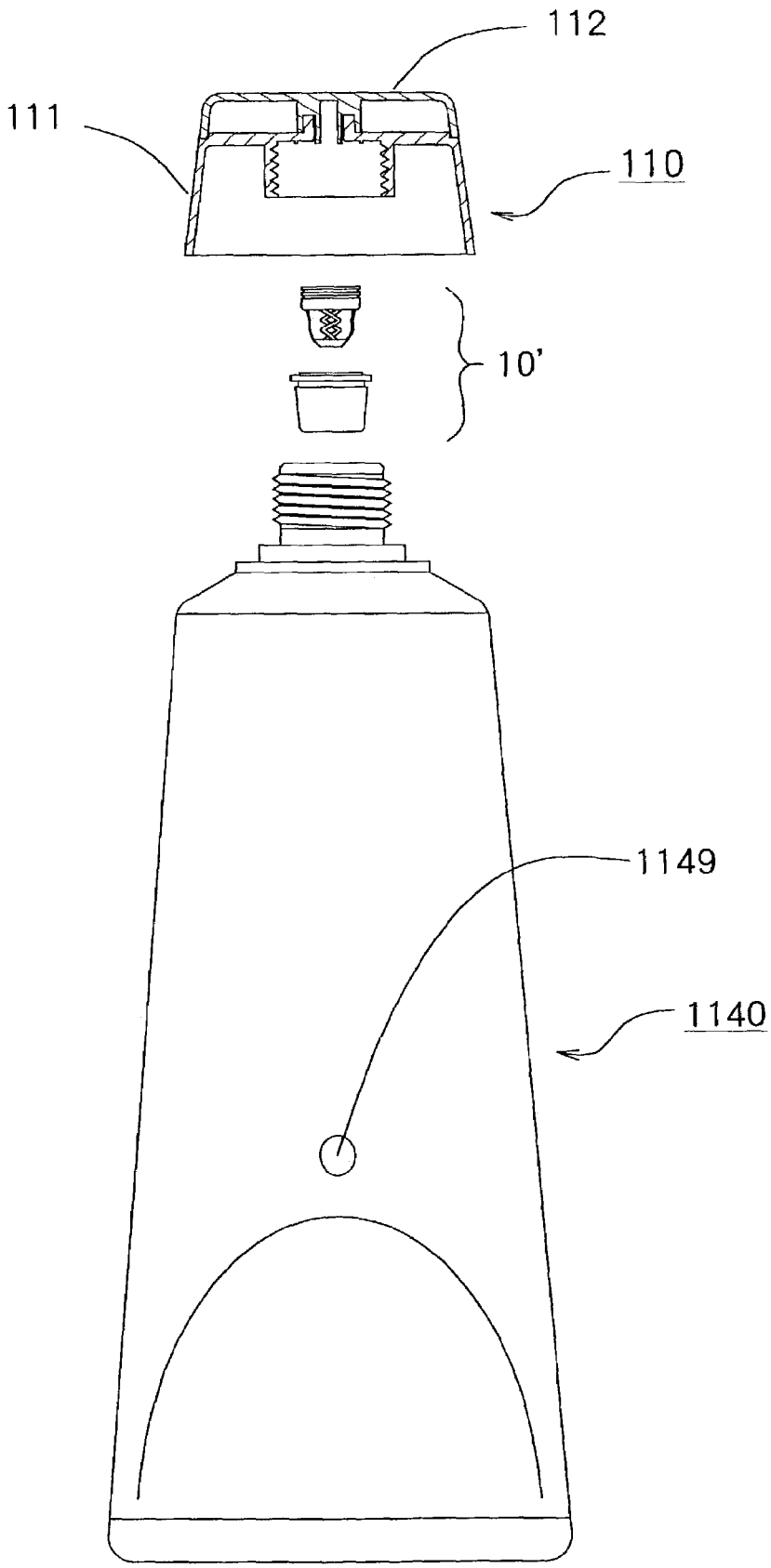
FIG. 29 is a front view of the tube-type fluid container according to Embodiment 10 of the present invention.
Figure 30:
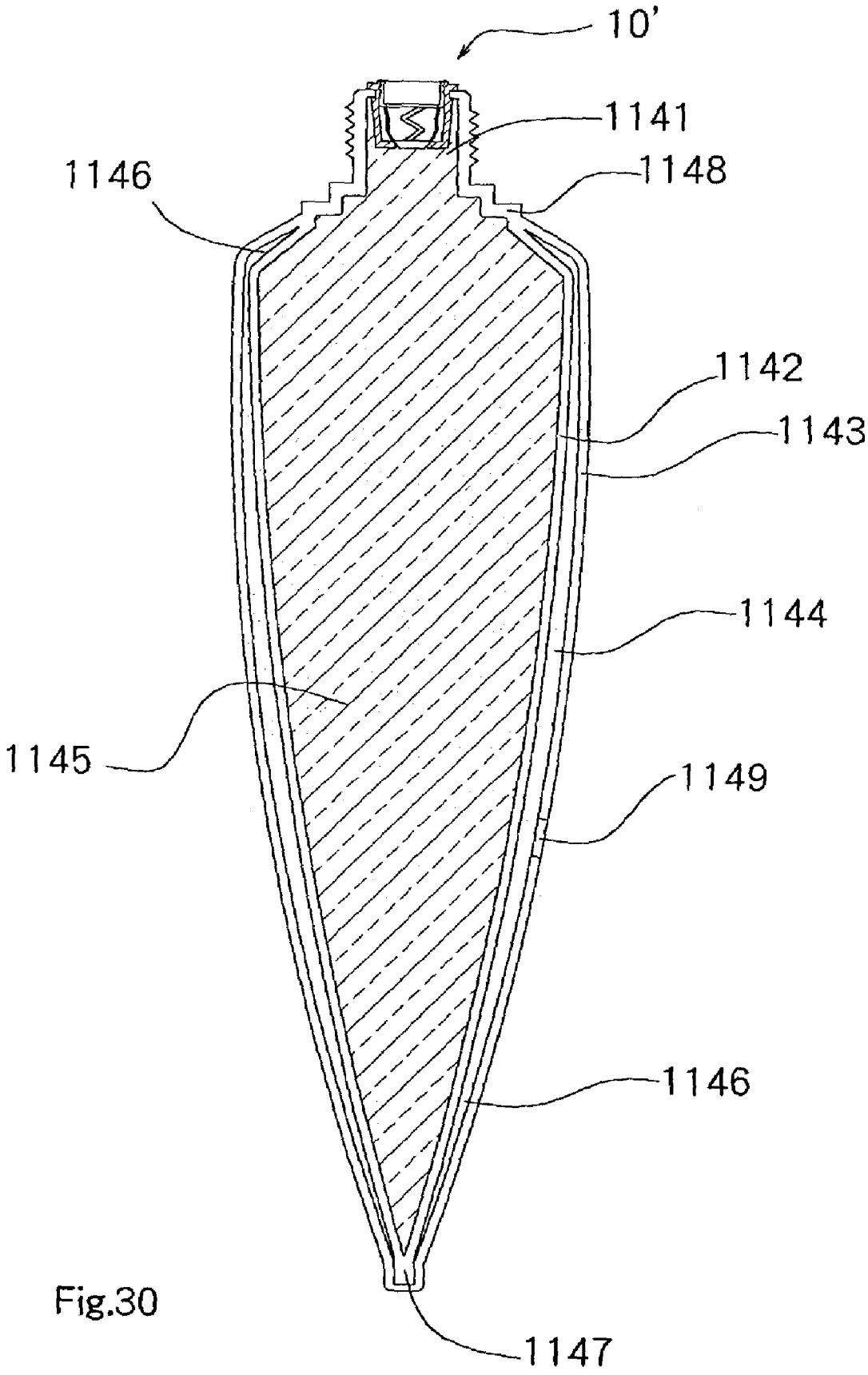
FIG. 30 is a lateral section showing the tube-type fluid container according to Embodiment 10 of the present invention, from which the lid material 110 is omitted.
Figure 31:
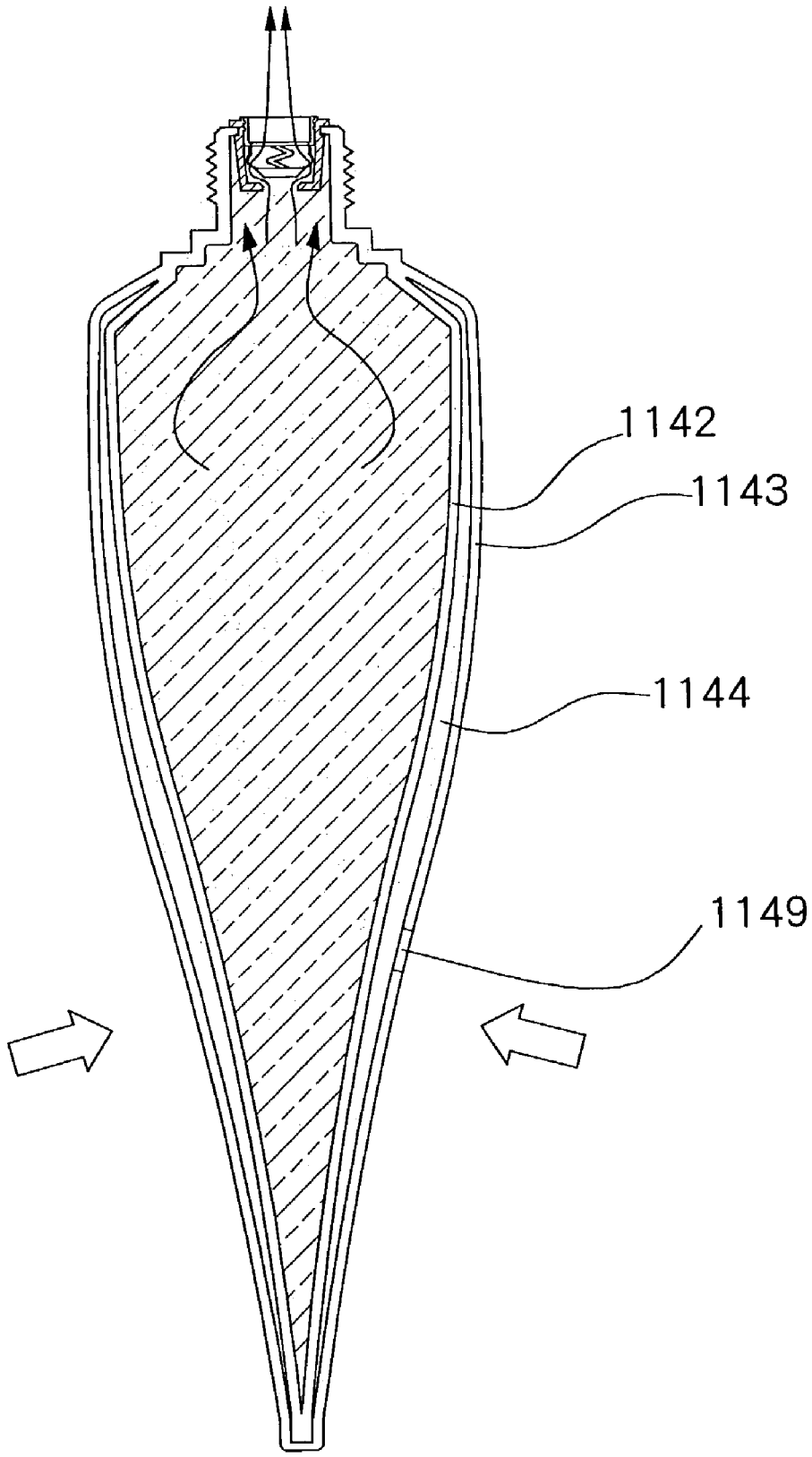
FIG. 31 is a lateral section showing a position when a pressure is applied to the tube-type fluid container according to Embodiment 10 of the present invention, from which the lid material 110 is omitted.
Figure 32:
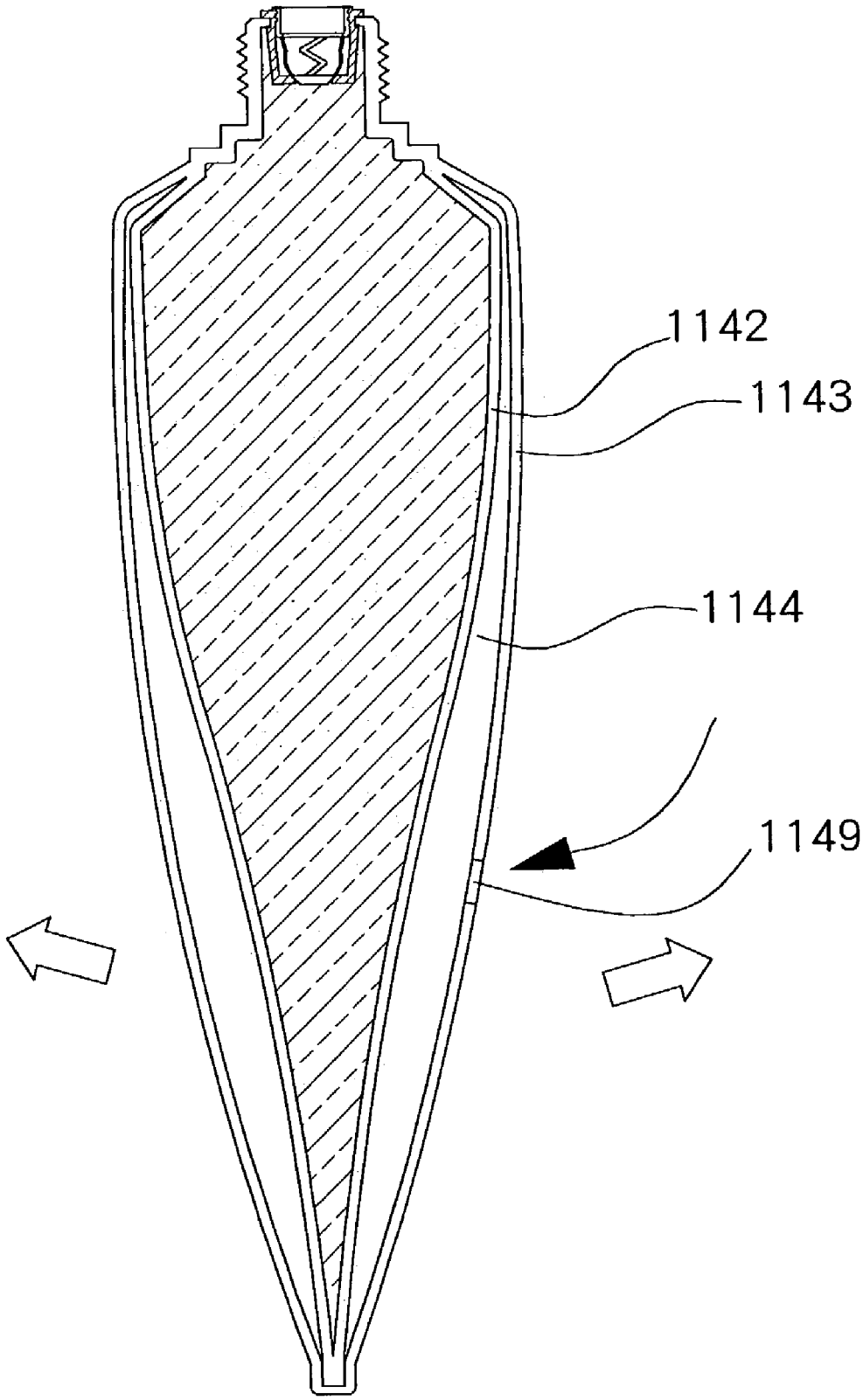
FIG. 32 is a lateral section showing a position when a shape of the external container 143 in the tube-type fluid container according to Embodiment 10 of the present invention is restored, from which the lid material 110 is omitted.

The tube-type fluid container according to Embodiment 10 of the present invention is described below. FIG. 29 is a front view of the tube-type fluid container according to Embodiment 10 of the present invention. FIG. 30 is a lateral section showing the tube-type fluid container according to Embodiment 10 of the present invention, from which the lid material 110 is omitted. FIG. 31 is a lateral section showing a position when a pressure is applied to the tube-type fluid container according to Embodiment 10 of the present invention, from which the lid material 110 is omitted. FIG. 32 is a lateral section showing a position when a shape of the external container 1143 in the tube-type fluid container according to Embodiment 9 of the present invention is restored, from which the lid material 110 is omitted. Additionally, a longitudinal section of the tube-type fluid container according to Embodiment 10 of the present invention is the same as the longitudinal section of the tube-type fluid container according to Embodiment 9 of the present invention.

This tube-type fluid container, in the same way as that according to Embodiment 9, possesses an internal container 1142 storing a fluid and an external container 1143 encompassing the internal container 1142. An internal space 1144 which is shut off from the outside is formed between the internal container 1142 and the external container 1143; in the external container 1143, a hole 1149 which communicates with the interior space and the outside is formed.

The hole 1149 formed in the external container 1143 at a pressing portion in the external container 1143, to which a pressure is applied when a fluid is pushed out. With this configuration, when the external container 1143 in the container main unit 1140 is pressed, a good part of the hole 1149 is blocked off, for example, by a pressing object such as a finger; an outflow of the air to the outside from the internal space can be controlled to be small; it becomes possible to apply a right pressure to the fluid inside the internal container 1142. The hole 1149 is larger than the hole 1149' in the previous embodiment (e.g., a diameter of 2–10 mm, 3–5 mm). One or more holes 1149 can be formed.

Because a size of the hole 1149 should be within the range not exceeding a size of the pressing object, a large amount of the air enters the internal space when the pressing object separates from the pressing portion. By this, the external container 1143 can quickly restore its original shape.

Additionally, the valve mechanism applied to the tube-type fluid container according to the present invention is not limited to the valve mechanisms 10 according to respective embodiments described above, but can be applied to any valve mechanisms in which an opening portion is opened when the container main unit 1140 is pressed and the opening portion is closed when a pressure applied to the container main unit 1140 is removed.

Additionally, for the external container 1143, a material with an elasticity recovering force needs to be used. For the internal container 1142, a material without an elasticity recovering force can be used.

In the above-mentioned embodiment, a configuration in which the opening portions of the internal container 1145 and of the external container 1146 are connected each other at a welding portion 1148 on the discharge port portion side of the container main unit, and the internal container and the external container are welded at their bottoms is adopted. A different configuration, in which the container main unit 1140 comprising three parts, a discharge port material having the male screw portion 151, the internal container 1142 and the external container 1143, and the opening portions of the internal container 1145 and of the external container 1146 are respectively welded to the discharge port material, can also be adopted.

In the present invention, any suitable plastic material can be used including rubbers such as silicon rubbers or soft resins such as soft polyethylene. For support portions (such as the valve seat portion) to which other portions (such as the valve portion) are fitted by press-fitting, hard resins such as hard polyethylene can preferably be used. The structures can be formed by any suitable methods including injection molding.

Various embodiments of valve mechanisms have been described above. However, the present invention is not limited to particular structures depicted in the drawings. Any suitable or feasible combinations of elements can be accomplished, and the present invention includes the following: That is, the present invention can also be characterized in that a valve mechanism comprises: (i) a valve seat portion having a nearly tubular shape, at the bottom of which a circular opening portion which functions as a valve seat is formed, (ii) a ring-shaped supporting portion which is arranged inside the valve seat portion, (iii) a valve body having a shape corresponding to the circular opening portion, and (iv) multiple coupling portions which couple the supporting portion and the valve body, wherein a resinous valve portion is constructed in such a way that the valve body can move between a closed position in which the valve body closes the opening portion in the valve seat portion and an open position in which the valve body opens the opening portion by the flexibility of the multiple coupling portions.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A valve mechanism adapted for a mouth portion of a tube-type fluid container, comprising:

a valve seat portion being cup-shaped having an opening at its bottom through which a fluid passes, said valve seat portion having an inner wall; and a resinous valve portion comprising: (i) a valve body having a shape corresponding to said opening; (ii) an annular support fixedly attached to the inner wall of the valve seat portion; and (iii) multiple connectors connecting the valve body and the support, wherein said connectors has isolated flection points elastically urging the valve body downward to close the opening and are outwardly bendable as the valve body moves upward, wherein when the valve body is moved upward to open the opening, the connectors move outward toward the inner wall.

2. The valve mechanism as claimed in claim 1, wherein the connectors comprise at least three coupling portions.

3. The valve mechanism as claimed in claim 1, wherein the isolated flection points of the connectors are in contact with the inner wall when moving outward.

4. The valve mechanism as claimed in claim 1, further comprising a guide mechanism which guides an upward and downward movement of the valve body.

5. The valve mechanism as claimed in claim 1, wherein each of the valve seat portion and the valve portion is formed with a single integrated piece made of a resin.

6. The valve mechanism as claimed in claim 1, wherein the valve seat portion is comprised of a cylindrical support having an upper opening and a lower opening, through which a fluid passes; and a valve seat having an opening at its bottom through which the fluid passes, said valve seat being fitted in inside the lower opening of the cylindrical support.

7. The valve mechanism as claimed in claim 1, wherein each of the valve seat portion and the valve portion is formed with a single integrated piece made of a resin.

8. A tube-type fluid container comprising a container body for storing a fluid having a mouth portion, and the valve mechanism of claim 1 attached to the mouth portion.

9. The container as claimed in claim 8, wherein the container body is a double wall container body comprised of an inner container for storing a fluid and an outer container, said inner container being flexible and compressible, said outer container having at least one through-hole for keeping an interior space between the inner container and the outer container at ambient pressure.

10. The container as claimed in claim 9, wherein the through-hole has a size which can let a small amount of air through.

11. The container as claimed in claim 9, wherein the through-hole is formed in a portion to which a pressure is applied when the fluid is discharged.

12. The container as claimed in claim 9, wherein the inner container and the outer container are integrated at the mouth portion, and welded at their bottoms.

13. The valve mechanism according to claim 1, wherein the connectors having the isolated flection points are N-shaped.

14. A valve mechanism adapted for a mouth portion of a tube-type fluid container, comprising:

a valve seat portion being cup-shaped having an opening at its bottom through which a fluid passes, said valve seat portion having an inner wall;

a resinous valve portion comprising: (i) a valve body having a shape corresponding to said opening; (ii) an annular support fixedly attached to the inner wall of the valve seat portion; and (iii) multiple connectors connecting the valve body and the support, said connectors elastically urging the valve body downward to close the opening and being outwardly bendable as the valve body moves upward, wherein when the valve body is moved upward to open the opening, the connectors move outward toward the inner wall; and a guide mechanism which guides an upward and downward movement of the valve body, wherein the guide mechanism comprises (a) a vertical guide pin provided in said valve body downstream thereof and (b) a hole portion having a hole wherein the guide pin is inserted, said hole portion being attached to an inner wall of the valve seat portion.

15. The valve mechanism as claimed in claim 14, wherein the coupling portions have flections.

16. A valve mechanism adapted for a mouth portion of a tube-type fluid container, comprising:

a valve seat portion being cup-shaped having an opening at its bottom through which a fluid passes, said valve seat portion having an inner wall;

a resinous valve portion comprising: (i) a valve body having a shape corresponding to said opening; (ii) an annular support fixedly attached to the inner wall of the valve seat portion; and (iii) multiple connectors connecting the valve body and the support, said connectors elastically urging the valve body downward to close the opening and being outwardly bendable as the valve body moves upward, wherein when the valve body is moved upward to open the opening, the connectors move outward toward the inner wall; and a guide mechanism which guides an upward and downward movement of the valve body, wherein the guide mechanism comprises (a) a guide plate having an outer diameter smaller than an inner diameter of the annular support and being slidable against an inner wall of the annular support, and (b) a rod connecting the guide plate and the valve body.

17. A valve mechanism adapted for a mouth portion of a tube-type fluid container, comprising:

a valve seat portion being cup-shaped having an opening at its bottom through which a fluid passes, said valve seat portion having an inner wall;

a resinous valve portion comprising: (i) a valve body having a shape corresponding to said opening; (ii) an annular support fixedly attached to the inner wall of the valve seat portion; and (iii) multiple connectors connecting the valve body and the support, said connectors elastically urging the valve body downward to close the opening and being bendable as the valve body moves upward; and a guide mechanism which guides an upward and downward movement of the valve body and restricts a sideways movement of the valve body, said guide mechanism being provided downstream of the valve body, wherein said guide mechanism is not subject to deformation.

18. The valve mechanism as claimed in claim 17, wherein said connectors comprise at least three coupling portions.

19. The valve mechanism as claimed in claim 17, wherein said coupling portions have flections.

20. The valve mechanism as claimed in claim 17, wherein the valve seat portion is comprised of a cylindrical support having an upper opening and a lower opening, through which a fluid passes; and a valve seat having an opening at its bottom through which the fluid passes, said valve seat being fitted in inside the lower opening of the cylindrical support.

21. A tube-type fluid container comprising a container body for storing a fluid having a mouth portion, and the valve mechanism of claim 17 attached to the mouth portion.

22. The container as claimed in claim 21, wherein the container body is a double wall container body comprised of an inner container for storing a fluid and an outer container, said inner container being flexible and compressible, said outer container having at least one through-hole for keeping an interior space between the inner container and the outer container at ambient pressure.

23. The container as claimed in claim 22, wherein the through-hole has a size which can let a small amount of air through.

24. The container as claimed in claim 22, wherein the through-hole is formed in a portion to which a pressure is applied when the fluid is discharged.

25. The container as claimed in claim 22, wherein the inner container and the outer container are integrated at the mouth portion, and welded at their bottoms.

26. A valve mechanism adapted for a mouth portion of a tube-type fluid container, comprising:

a valve seat portion being cup-shaped having an opening at its bottom through which a fluid passes, said valve seat portion having an inner wall;

a resinous valve portion comprising: (i) a valve body having a shape corresponding to said opening; (ii) an annular support fixedly attached to the inner wall of the valve seat portion; and (iii) multiple connectors connecting the valve body and the support, said connectors elastically urging the valve body downward to close the opening and being bendable as the valve body moves upward; and a guide mechanism which guides an upward and downward movement of the valve body and restricts a sideways movement of the valve body, said guide mechanism being provided downstream of the valve body, wherein said guide mechanism comprises (a) a vertical guide pin provided in said valve body and (b) a hole portion having a hole wherein the guide pin is inserted, said hole portion being attached to an inner wall of the valve seat portion.

27. A valve mechanism adapted for a mouth portion of a tube-type fluid container, comprising:

a valve seat portion being cup-shaped having an opening at its bottom through which a fluid passes, said valve seat portion having an inner wall;

a resinous valve portion comprising: (i) a valve body having a shape corresponding to said opening; (ii) an annular support fixedly attached to the inner wall of the valve seat portion; and (iii) multiple connectors connecting the valve body and the support, said connectors elastically urging the valve body downward to close the opening and being bendable as the valve body moves upward; and a guide mechanism which guides an upward and downward movement of the valve body and restricts a sideways movement of the valve body, wherein said guide mechanism comprises (a) a guide plate having an outer diameter smaller than an inner diameter of the annular support and being slidable against an inner wall of the annular support, and (b) a rod connecting the guide plate and the valve body.

* * * * *